US006463616B1

(12) United States Patent
Morokutti

(10) Patent No.: US 6,463,616 B1
(45) Date of Patent: Oct. 15, 2002

(54) FLOOR CLEANING MACHINE

(75) Inventor: Gregor Morokutti, Wagna (AT)

(73) Assignee: Rotowash Reinigungsmaschinen Ges.m.b.H, Wagna (AT)

( * ) Notice: Subject to any disclaimer, the term of this patent is extended or adjusted under 35 U.S.C. 154(b) by 0 days.

(21) Appl. No.: 09/285,861

(22) Filed: Apr. 2, 1999

(30) Foreign Application Priority Data

Apr. 14, 1998 (AT) ..... 635/98

(51) Int. Cl.[7] ..... A47L 11/14; A47L 11/292

(52) U.S. Cl. ..... 15/50.3; 15/48; 15/52.1; 15/79.2; 15/83

(58) Field of Search ..... 15/44, 48, 48.1, 15/50.3, 52.1, 79.1, 79.2, 82, 83

(56) References Cited

U.S. PATENT DOCUMENTS

| | | | | |
|---|---|---|---|---|
| 937,353 A | | | 10/1909 | Ackerman |
| 1,464,031 A | | | 8/1923 | Daly |
| 1,767,983 A | | * | 6/1930 | Hughes |
| 2,842,788 A | | * | 7/1958 | Rench |
| 3,798,697 A | | | 3/1974 | Lowder |

FOREIGN PATENT DOCUMENTS

| | | |
|---|---|---|
| CH | 249 087 A | 6/1947 |
| DE | 153 181 | 4/1903 |
| DE | 26 17 382 A | 11/1977 |
| FR | 1 377 041 A | 10/1964 |

* cited by examiner

*Primary Examiner*—Randall E. Chin
(74) *Attorney, Agent, or Firm*—Henry M. Feiereisen

(57) ABSTRACT

A drive system for driving two cylindrical brushes of a floor cleaning machine that rotate in opposite directions is disclosed. The floor cleaning machine includes a motor, a gear mechanism and force-transmission means for transmitting a torque from the gear mechanism to the cylindrical brushes. The gear mechanism has a separate driven shaft for each cylindrical brush.

11 Claims, 23 Drawing Sheets

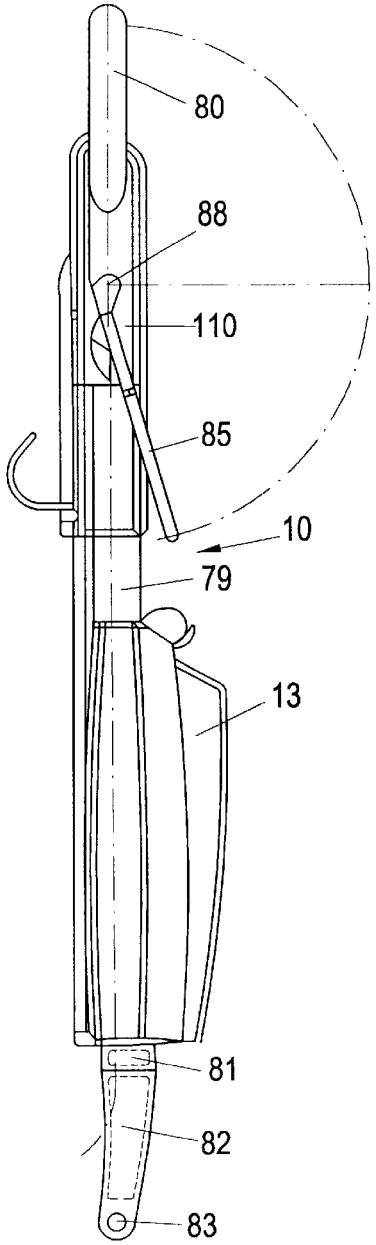
FIG. 17a
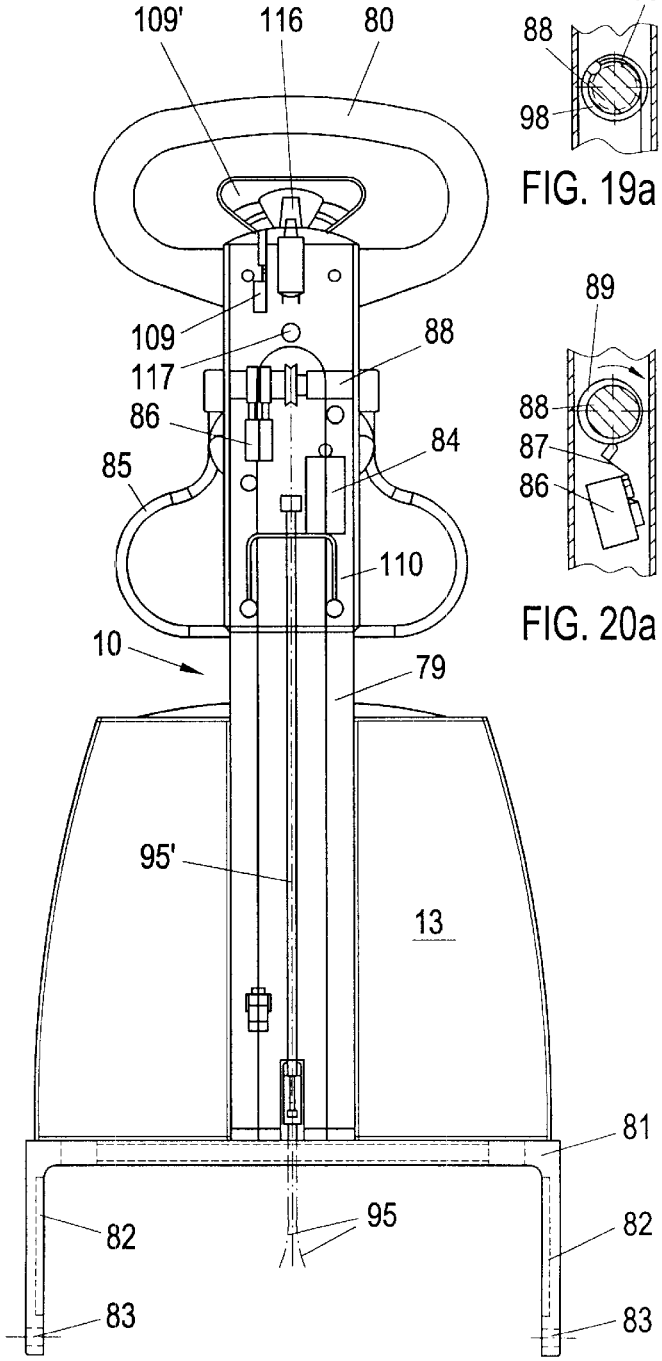
FIG. 18a
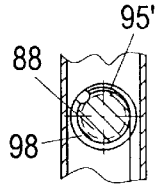
FIG. 19a
FIG. 20a

FLOOR CLEANING MACHINE

CROSS-REFERENCES TO RELATED APPLICATIONS

This application claims the priority of Austrian Patent Application Serial No. A 635/98, filed Apr. 14, 1998, the subject matter of which is incorporated herein by reference.

BACKGROUND OF THE INVENTION

The present invention relates to a drive system for two counter-rotating cylindrical brushes of a floor cleaning machine which includes a motor, a gear mechanism and a force transmitting system for transmitting a torque from the gear mechanism to the cylindrical brushes.

Floor cleaning machines with two counter-rotating cylindrical brushes are known. Such machines typically include a rotating drum that is arranged between the cylindrical brushes and has a rotation axis that is located above the rotation axes of the cylindrical brushes. Water is applied to the floor to be cleaned or to one of the brushes, and the water together with the dirt, picked up by the brushes, is then propelled towards the drum surface. A water film forms on the drum which holds the dirt that is picked up from the floor on the surface of the drum. Also provided are devices for lifting the soiled water film from the drum and transferring the soiled water film to a waste water container.

SUMMARY OF THE INVENTION

In general, it is an object of the invention to provide an improved design of such floor cleaning machines. The object is attained by several design features described hereinafter.

A first important aspect of the invention is the drive system. The drive system includes—as mentioned above—a motor, a gear mechanism and a force transmitting system for transmitting a torque from the gear mechanism to the cylindrical brushes. Conventional gear mechanisms have a single driven shaft. Typically, the two cylindrical brushes are driven by a multistage gear drive disposed on each cylindrical brush, i.e., by several meshing gear wheels having parallel rotation axes. A gear mechanism constructed in this manner disadvantageously requires multiple stages to drive the brushes, which significantly reduces the efficiency of the drive system and also generates objectionable noise.

It is therefore an object of the invention to obviate these drawbacks, and to provide a drive system of the type described above with a high efficiency.

This object is attained in accordance with the invention by providing each cylindrical brush with its own separate driven shaft.

In this way, both cylindrical brushes can be connected directly and independently of each other to the gear mechanism, and a malfunction of one drive connection does not affect the other drive connection. The direct connection of each brush to the gear mechanism produces the required high efficiency.

According to a preferred embodiment of the invention, the force transmitting system may include toothed disks and toothed belts which are secured to the driven shafts and to the shafts of the cylindrical brushes and which connect one of the toothed disks of the driven shaft with a respective toothed disk located on the cylindrical brush. A toothed belt drive of this type is very effective and highly efficient. The toothed belt drive also operates very quietly, so that of the cleaning machine produces very little noise.

According to another embodiment of the invention, a further toothed disk may be secured on a driven shaft and connected via another toothed belt to a toothed disk that is secured on the driven shaft of the drum. The drum is then driven independently from the brushes, so that the drum is still operational in the event that the drives of the brushes malfunction. Furthermore, the toothed belt drive is very effective and operates very quietly.

According to another feature of the drive system of the invention, the gear mechanism may include a pinion secured to the motor drive shaft and two primary gear wheels that engage with the pinion, as well as a secondary gear wheels meshing with the primary gear wheels, wherein the first driven shaft is connected to one of the primary gear wheels and the second driven shaft is connected to the secondary gear wheel. In this manner, the counter-rotation of the cylindrical brushes can be attained employing only a few components. The driven shafts of the gear mechanism are connected to the motor pinion only via one or two stages, thereby further contributing to the high overall efficiency of the drive system.

According to yet another feature of the invention, the pinion, the primary gear wheels and the secondary gear wheel may be implemented as spur gears made of steel. This guarantees a long lifetime of the gear wheels.

According to another advantageous feature of the invention, the pinion, the primary gear wheels and the secondary gear wheel may be helical gears that are known to produce a particularly low noise level .

The toothed disks of the force transmitting system may also be made of steel, aluminum, plastic and the like. Toothed disks made of steel advantageously have a long lifetime which reduces the frequency of repairs of the cleaning machine. Plastic and aluminum gears advantageously produce low noise levels.

According to another embodiment of the invention, the motor is a synchronous motor. Motors of this type can be controlled with relatively simple control circuits. Moreover, synchronous motors are known to support the high brush rotation speed required, for example, for waxing floors. Consequently, the cleaning machine according to the invention is suitable for waxing floors, in particular marble floors.

Advantageously, an electronic device for controlling the rotation speed of the motor can be provided to adapt the cleaning machine to different dirt conditions encountered in practice. The motor can be started smoothly with such control, thereby improving the motor lifetime.

According to another advantageous feature, the floor cleaning machine of the invention includes a stripping device for lifting the soiled water film from the floor, transferring the film to the drum and then transferring the soiled water film to a waste water container. Such floor cleaning machines with a stripping device with at least one rotating brush, preferably a cylindrical brush, and with a drum, on which a water film is disposed and to which the dirt picked up by the brush is transferred, are known in the art. The stripping device lifts this soiled water film from the drum and transfers the film to a waste water container. The stripping device is formed as a strip which contacts the outer surface of the drum along the entire width of the drum.

Conventionally, the strip is biased by a plurality of spaced-apart springs and thereby pressed against the surface of the drum. The thus realized pressing of the strip at only spaced-apart localized points may cause problems, since the water film is then properly lifted from the drum surface only in certain sections, while the water film in other sections forms a dam in front of the strip before being lifted. This significantly impairs the reliable removal of dirt.

It is therefore another object of invention to provide an improved stripping device which obviates these drawbacks and ensures that the water film is reliably lifted across the entire width of the drum.

Thus, according to another aspect of the invention, a rigid strip holder is provided that extends substantially across the entire lengths of the strip, wherein the strip holder is biased towards the surface of the drum by at least one spring. The rigid strip holder distributes the spring bias force evenly across the entire length of the strip and therefore biases the strip against the drum surface with a biasing force that is constant over the entire length of the strip. Uneven biasing forces that can otherwise cause the water film to form a dam, are thereby eliminated.

Advantageously, the strip holder is pivotally supported, with the spring pivoting the portion of the strip holder carrying the strip towards the drum surface. This type of support can be easily implemented.

According to yet another feature of the invention, the strip holder can be secured in fixed rotative engagement on a pivot shaft which projects beyond the end faces of the strip holder and is supported in the side members of the floor cleaning machine. A lever is arranged on at least one pivot shaft end that projects beyond the side member, with the at least one spring acting on the lever. The spring acting on the lever can then be secured to the side member, so that the floor cleaning machine is of significantly simpler construction than could otherwise be achieved if the spring were attached at a level with the drum.

According to another feature of the invention, the spring may be implemented as a compression spring, with one end of the spring supported on the side member and the other end of the spring supported on the lever. Such springs are standard components, and their use reduces the manufacturing cost and facilitates maintenance of the floor cleaning machine according to the invention.

According to yet another embodiment of the invention, the compression spring may be accommodated in a housing formed as a hollow cylinder and closed off on one end, wherein the housing is supported for rotation parallel to the plane of the side member, with the one end of the compression spring being supported on the bottom of the housing, whereas the second end is supported on a piston extending into the housing and rotatably supported on the lever. The compression spring is thereby encapsulated and sealed against dust and protected from the environment.

According to another embodiment of the invention, the spring can be formed as a tension spring, with one end of the spring secured to a side member and the other end of the spring secured to the lever. These springs are also standard components, so that their use results in a simplified maintenance of the floor cleaning machine and in reduced the manufacturing cost.

In addition, a conventional stripping device adapted for use with a floor cleaning machine of a type having at least one rotating brush, preferably a cylindrical brush, and a rotating drum on which a water film is arranged for receiving dirt picked up by the brush, and provided for lifting the soiled water film from the drum and transferring the film to a waste water container, has the following further drawback: Dirt, in particular dirt in form of long fibers, tends to accumulate and form a dam on the strip, and is therefore not immediately transferred to the waste water container. When the dam is formed on the stripping device, the stripping device frequently clogs, interrupting the cleaning process.

It is therefore an object of the invention, to provide a new design of a stripping device, which ensures that the dirt is transferred directly to the waste water container.

According to the invention, this object is attained by providing a rotating cylindrical brush that extends substantially across the entire width of the drum, with the free brush ends of the brush bearing upon the drum surface.

Unlike conventional stripping devices, the stripping device according to the present invention lifts the dirt from the drum surface and simultaneously transfers the dirt to the waste container. Consequently, the dirt cannot form a dam.

Another aspect of the present invention relates to the handle of the floor cleaning machine for manual maneuvering the machine. Conventional floor cleaning machines that include a motor, preferably an electric motor, for driving cleaning devices, such as cylindrical brushes, and at least one switch to switch the motor on and off, employ a handle which operates the switch with a portion of the handle. Typically, the switch is actuated by pivoting the entire handle. For example, if the handle is oriented perpendicular to the floor, the switch is switched OFF, whereas when the handle is pivoted by a predetermined angle, then the switch is moved into an ON position, which starts the floor cleaning machine. This mode of actuation has however the drawback that the machine can be inadvertently switched on even though the intention of the user is only to move the machine with the handle.

It is therefore another object of the invention to provide an improved handle which can be tilted in an arbitrary direction without activating the switch.

This object is attained according to the present invention by providing a switch that is arranged at a fixed location on the handle, wherein the portion of the handle that actuates the switch is implemented in form of a lever that can be pivoted with respect to the handle. In this way, the switch can be actuated independent of the rotation angle of the handle, thereby entirely eliminating the disadvantages described above.

Advantageously, the lever may include a pivot shaft supported in the handle, wherein a separate actuator is provided on the pivot shaft for each switch, and wherein the actuating element of the switch is attached to the handle and located in the path along which the actuator is rotated. The switch can then be arranged inside the handle and effectively protected from the environment.

According to another embodiment of the present invention, the actuator can be formed by a cylindrical disk that is eccentrically secured to the rotating shaft. This configuration realizes a smooth activation of the actuating element, thereby extending the lifetime of the switch.

According to another feature of the invention, the at least one switch can be a microswitch having a lever as an actuating element. Microswitches are standard components which contribute to reduced manufacturing costs of the floor cleaning machine. Moreover, microswitches have a long lifetime and therefore make the floor cleaning machine more reliable.

The present invention also relates to a handle for a floor cleaning machine with cleaning devices that make contact with the floor, in particular cylindrical brushes, as well as with an undercarriage having wheels supported in wheel supports which are movable with respect to the cleaning devices. The wheels can thereby be raised above or lowered below the section of the cleaning devices that contacts the floor, by using a portion of the handle. Conventionally, the wheel supports are normally raised and lowered by moving the entire handle. For example, the wheel supports are lowered by orienting the handle perpendicular to the floor, whereas the wheel supports are raised by rotating the handle by a certain angle. In this way, however, the undercarriage can be inadvertently raised when the machine is only to be moved using the handle.

It is therefore an object of the present invention to provide an improved handle which can be tilted regardless if the wheel supports are to be raised or lowered.

This object is attained in accordance with the invention, by providing the portion of the handle, which raises the undercarriage, in the form of a lever which is pivotally supported on the handle, and by providing cables having first ends secured to the wheel support of the undercarriage and second ends secured to the lever. The wheel supports can then be lifted independently of the tilt angle of the handle, thereby eliminating the disadvantages described above.

According to another feature of the present invention, the lever may include a pivot shaft supported on the handle, wherein the second end of the cables is secured to the outer surface of the pivot shaft. In this way, the cables can be routed inside the handle and thereby effectively protected from the environment. Advantageously, the cables can be guided in a particularly good manner by attaching disks on the pivot shaft on both sides of the attachment points of the cables.

The invention also relates to a floor cleaning machine of a type including at least one rotating brush, preferably a cylindrical brush, a rotating drum having a water film that receives the dirt picked up by the brush, and a nozzle for applying water for the water film to the floor to be cleaned or at least to a rotating brush. Common to all conventional floor cleaning machines is the fact that water for the water film is ejected through nozzles that are rigidly attached to the machine and are oriented in such a way that the cone of the water jet either impinges entirely on the floor to be cleaned or entirely on a brush.

Water, however, is preferably applied to different areas depending on the type of the floor to be cleaned: In floors that strongly absorb water, for example carpets, water should be applied to the brush and not to the absorbent floor; whereas in floors that do not absorb water, for example tiled floors, concrete or parquet, water should be aimed directly to the floor. Conventional machines with rigid attachment of the nozzles to the floor cleaning machine can only be used for a specific type of floor.

It is therefore an object of the invention, to provide an improved floor cleaning machine, which can be equally employed with absorbent and non-absorbent floors.

This object is attained in accordance with the present invention, by so securing the nozzle to the floor cleaning machine as to be rotatable about an axis that is approximately perpendicular to the symmetry axis of the water spray cone. The user can then easily adjust the location where the jet spray cone impinges on the floor and/or brush and select the orientation of the cone according to the requirements of the floor to be cleaned.

Advantageously, the nozzle may have at least one locking lug which cooperates with recesses disposed in the region of the nozzle of the floor cleaning machine. In this way, the nozzle cannot be tilted by the hydraulic force and the recoil forces acting on the nozzle, and therefore remains in the position selected by the user.

The present invention also relates to a transport cart for a floor cleaning machine of a type described above, with wheels and a hand grip. Transport carts that are specifically designed for floor cleaning machines are not known in the art. Until now, floor cleaning machines could only be moved with the help of the undercarriage attached to the machines—if such undercarriage is provided at all. As the undercarriage of the floor cleaning machines typically has relatively small wheels, a maneuvering becomes difficult when negotiating obstacles, such as doors saddles or low steps. Alternatively, the use of common transport carts having a frame, four wheels, a support surface and a hand grip was proposed. While these common transport carts do not encounter the problems as discussed above, because they significantly greater wheels, these carts, however, make it difficult to move the floor cleaning machine since the machine has to be lifted by hand onto and from the support surface, which is time-consuming and exhausting.

It is therefore an object of the invention, to provide an improved transport cart which is simple in design and can receive a floor cleaning machine such that the floor cleaning machine can be moved onto and from the transport cart in a simple and ergonomically advantageous manner.

This object is attained in accordance with the present invention, by providing a transport cart which includes a frame having a handle, a mounting, connected to a handle-distal end of the frame, for support of wheels for mobility of the frame, support braces, secured to the mounting, for supporting the transport cart; and, receiving rods, secured to the mounting, for engagement in pockets of the floor cleaning machine. Because of its simple construction, the transport cart can be easily and inexpensively manufactured. In addition, the transport cart is small and therefore takes up very little space. Since the receiving rods can engage pockets provided in the floor cleaning machine, there is no need to lift the floor cleaning machine by hand for placement onto the transport cart or removal from the transport cart.

According to another feature of the present invention, the hand grip may include holders for spare parts for the floor cleaning machine, in particular replacement brushes. In this way, essential replacement parts can be stored at specific locations known to the user of the floor cleaning machine and are readily accessible.

In addition, at least one coupling member may be provided, such as a rope, a rigid bracket and the like, which can be attached at one end to the frame and at the other hand to the floor cleaning machine, after the machine is placed onto the transport cart, for reliably securing the floor cleaning machine to the transport cart.

BRIEF DESCRIPTION OF THE DRAWING

The above and other objects, features and advantages of the present invention will now be described in more detail with reference to the accompanying drawing, in which:

FIG. 17*a* shows the handle of FIGS. 16*d–f* in the representation of FIG. 17;

FIG. 18*a* shows the handle of FIGS. 16*d–f* in the representation of FIG. 18;

FIG. 19*a* shows the handle of FIGS. 16*d–f* in the representation of FIG. 19;

FIG. 20*a* shows the handle of FIGS. 16*d–f* in the representation of FIG. 20;

DETAILED DESCRIPTION OF PREFERRED EMBODIMENTS

Figure 1:
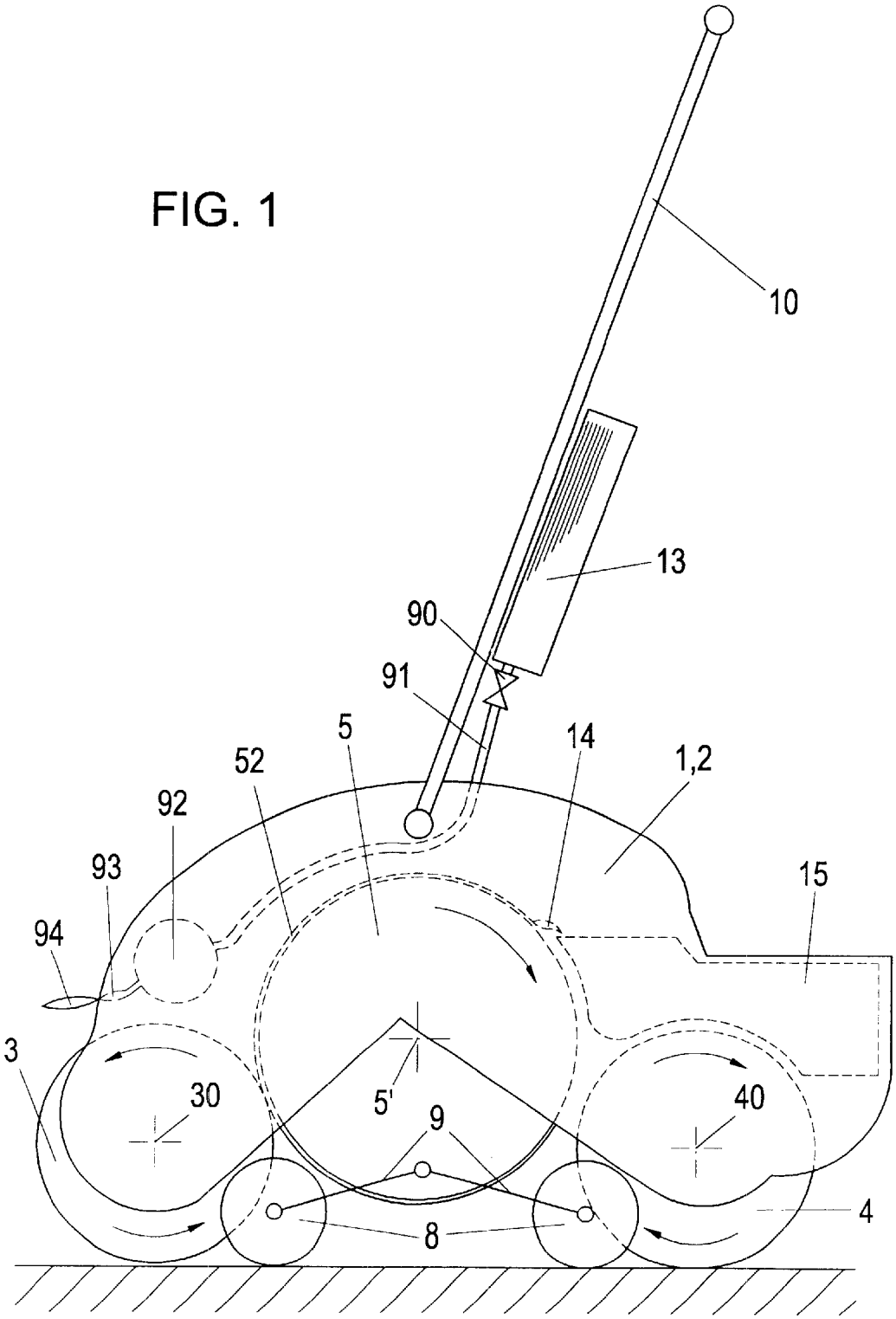
FIG. 1 is schematically a side view of a floor cleaning machine according to the invention.

Throughout all the Figures, same or corresponding elements are generally indicated by same reference numerals.

Figure 2:
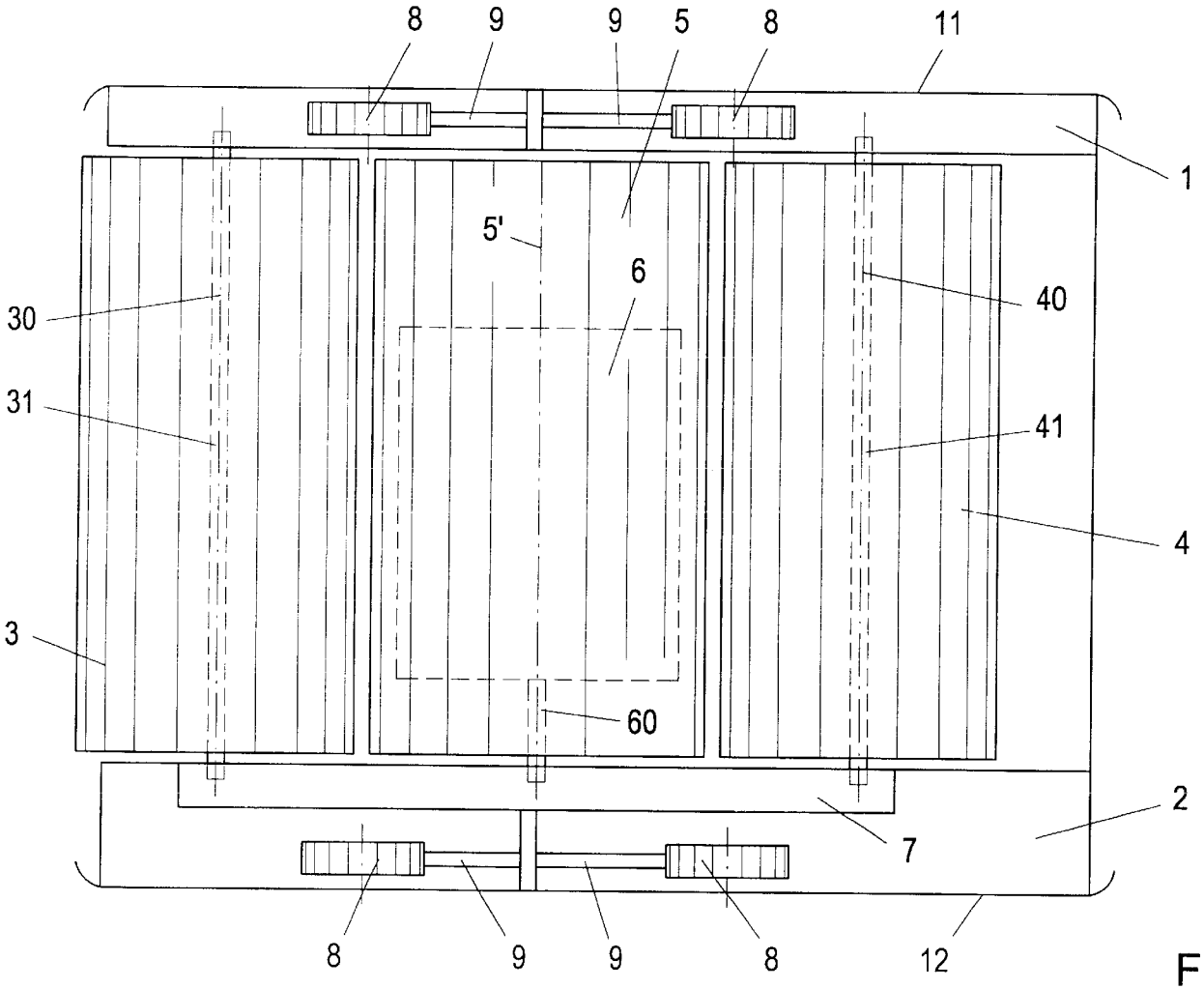
FIG. 2 is a bottom view of the floor cleaning machine according to FIG. 1.

Referring now to FIGS. 1 and 2, there are shown schematically a floor cleaning machine according to the invention, including two spaced-apart side members 1 and 2 in parallel relationship, with two cylindrical brushes 3, 4 disposed between the side members 1, 2 and mounted on shafts 31, 41 (FIG. 3), with proximate ends of bristles, which extend radially outwardly from the shafts 31, 41, secured to the shafts 31, 41.

The axes of symmetry 30, 40 of the cylindrical brushes 3, 4 are oriented essentially perpendicular to the surfaces of the side members 1, 2. The shafts 31, 41 project beyond the end faces of the cylindrical brushes 3, 4 and are supported for rotation in the side members 1, 2. A drum 5 in the form of a hollow cylinder is arranged between the cylindrical brushes 3, 4 and has a symmetry axis 5' that is also oriented essentially perpendicular to the surfaces of the side members 1, 2 and is supported for rotation therein. The two cylindrical brushes 3, 4 preferably rotate in opposite directions, whereas the drum 5 rotates in the same direction as the rear cylindrical brush 4 (see arrows in FIG. 1 indicating the rotation direction). The brushes 3, 4 and the drum 5 are driven by a motor 6 which is arranged inside the hollow cylindrical drum 5. The motor 6 has a stator which is secured to the side members 1, 2 (see FIG. 2), and a driven shaft 60 which projects beyond the end face of the drum 5 and extends into a gear arrangement 7 secured to the side member 2. The gear arrangement 7 connects the driven motor shaft 60 with the drive pinion of the cylindrical brushes 3, 4 and the drum 5.

The floor cleaning machine according to the invention is not self-propelled and must therefore be moved by hand. To move the machine, a handle 10 which terminates approximately at hip height, is attached on the upper ends of the side members 1, 2. A fresh water container 13 is arranged on the handle 10. Water is conducted downwardly from the fresh water container 13 and is either applied in front of the cylindrical brush 3 to the floor to be cleaned, or is directly applied to the brush 3 in form of a spray cone.

Water is applied to the floor to be cleaned or to the cylindrical brush 3 as follows: water is drawn from the fresh water container 13 by a pump 92 through a valve 90 (ball valve and the like) and a hose 91 and conveyed to a nozzle 94 through another hose connection 93 or a similar distribution arrangement. The nozzle 94 spays the water onto the floor or onto the cylindrical brush 3 over an area covering the entire width of the brush in front of the front cylindrical brush 3. The spray cone 113 formed by the nozzle 94 is illustrated in FIGS. 2*a, b.*

The two cylindrical brushes 3, 4 propel the dirt that is picked up from the floor together with the sprayed water towards the drum 5, thereby forming on the drum 5 a water film 52 which retains the dirt on the surface of the drum 5. If fresh water is applied directly to the cylindrical brush 3, the brushes 3, 4 lift from the floor only the dirt encountered on the floor. The water applied to the brush 3, however, is also propelled in the direction of the drum 5, thereby forming on the drum surface a water film 52 that retains the dirt.

A stripping device 14 contacting the drum 5 is positioned approximately at the 1 o'clock position of the drum 5. This stripping device 14 lifts the soiled water film 52 from the drum surface and transfers the film to a waste water container 15. After passing the stripping device 14, a new water film 52 containing dirt lifted from the floor is formed on the drum 5. The thickness of the water layer 52 depends on the amount of water used. A small amount of water provides a thin water film. The amount of a water, however, has to be large enough so that the water film 52 can retain the dirt on the outer surface of the drum.

Figure 2B:
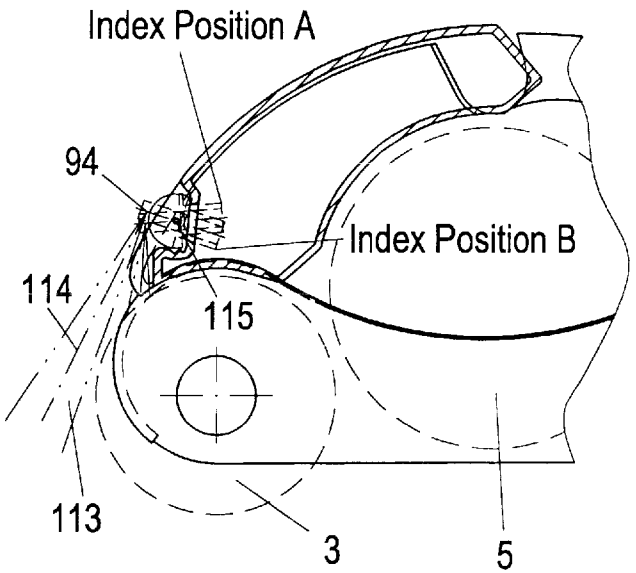
FIG. 2*b* is a side view of the floor cleaning machine showing the spray cone.
Figure 2A:
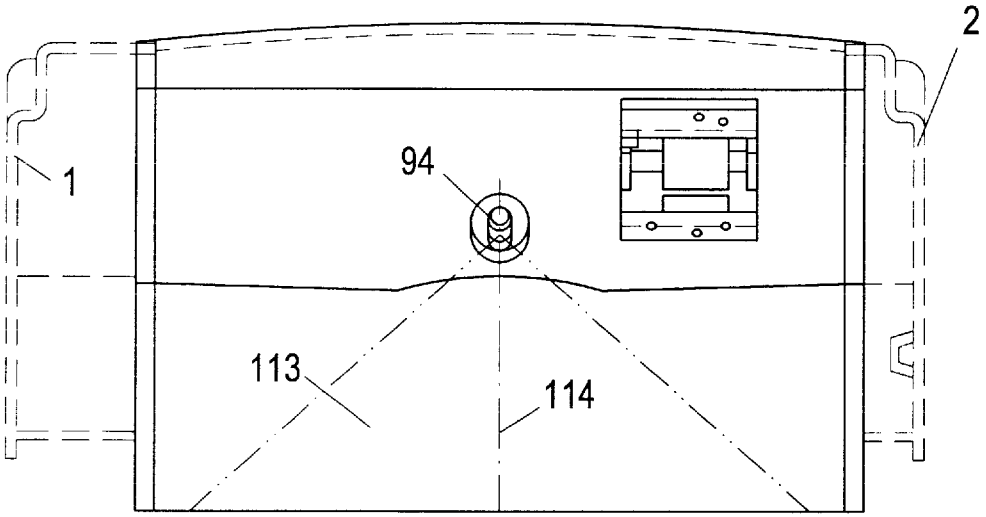
FIG. 2*a* is a front view of the floor cleaning machine showing the spray cone.
Figure 2D:
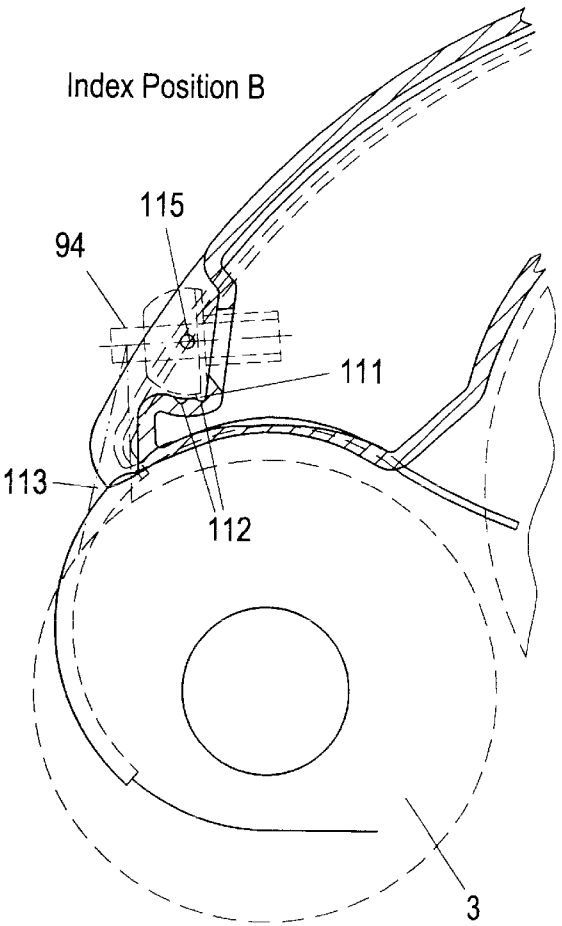
FIG. 2*d* shows the nozzle of the floor cleaning machine in a second tilt position (B)
Figure 2C:
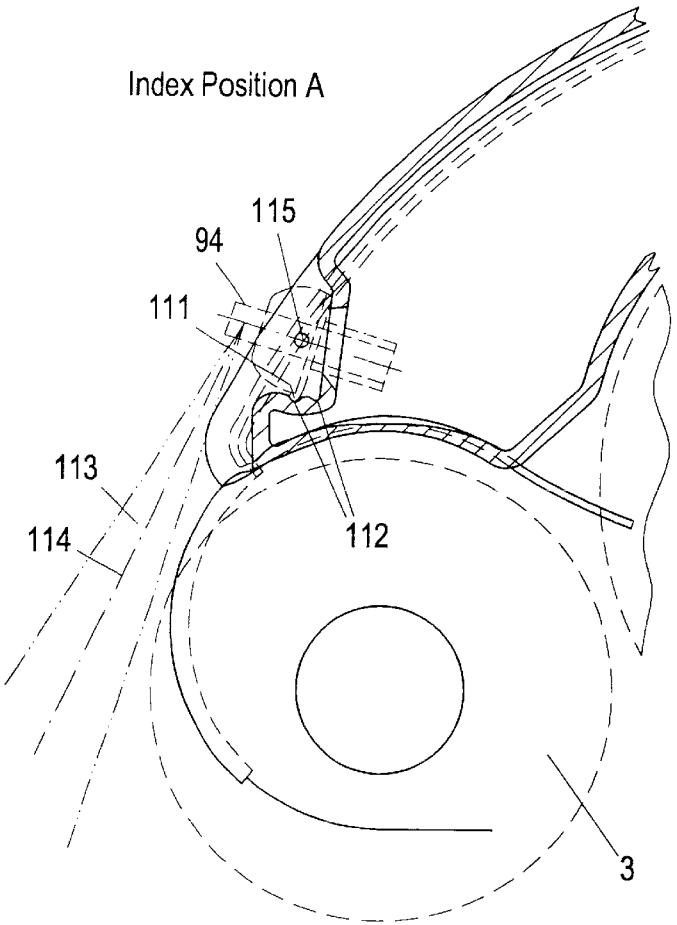
FIG. 2*c* shows the nozzle of the floor cleaning machine in a first tilt position (A)

As seen in FIG. 2*b* and also in FIGS. 2*c, d,* the nozzle 94 can be secured to the floor cleaning machine for pivoting about an axis 115 oriented perpendicular to the symmetry axis 114 of the spray cone. The nozzle can assume two pivot positions, with the first position indicated as "index position A" and the second position as "index position B." The nozzle position can be adjusted by the user directly at the nozzle 94. Alternatively, a mechanical actuating device (for example, a cable) or an electrical actuating device (for example, a magnetic coil with a movable armature) can be provided to remotely control the nozzle 94 (for example, with an actuating element secured to a handle 10 described in greater detail below).

As shown more clearly in FIGS. 2*c, d,* the nozzle 94 includes at least one locking lug 111 adapted to engage in pockets 112 arranged on the floor cleaning machine in the region of the nozzle 94. This ensures to maintain the nozzle 94 in the selected position. In the index position A (see FIG. 2*c*), the nozzle 94 is so oriented that the spray cone 113 does not contact the cylindrical brush 3, but rather impinges entirely on the floor to be cleaned. Conversely, in the index position B (FIG. 2*d*), the nozzle 94 is so oriented that the spray cone 113 impinges entirely on the cylindrical brush 3.

The user of the floor cleaning machine can select a suitable spray mode for the respective floor by simply indexing the nozzle 94 (index position A for hard, non-absorbing floors, and index position B for absorbing floors), so that a floor cleaning machine according to the invention cleans uniformly regardless of the floor type.

It is sufficient, for proper operation of the floor cleaning machine, to provide the side members 1, 2 in the form of flat plates. Suitably, the side members 1, 2 are in the form of hollow bodies to cover the ends of the shafts and the gear arrangement 7, i.e. the side members 1, 2 include covers 11, 12, as will be discussed in more detail furtherbelow with reference to the construction of the floor cleaning machine of the invention.

An undercarriage is attached to the side members 1, 2, and includes four wheels 8 which are supported by wheel supports 9 that are movable with respect to the cylindrical brushes 3, 4. The wheel supports 9 are in the form of levers, with the wheels 8 supported in first ends of these levers. The second ends of the wheel supports 9 are swingably secured to the side members 1, 2. The lever-shaped wheel supports 9 can be tilted back and forth into the direction of the arrow through means that are further described below. Either the wheels 8 (when the wheels 8 are lowered) or the cylindrical brushes 3, 4 (when the wheels 8 are raised) of the floor cleaning machine can be selected to touch the floor. In the latter position, the floor can be cleaned, whereas in the former position the machine can be moved easily, without cleaning the floor.

Following this overview over the basic design of the floor cleaning machine of the invention, the construction of the machine will now be described in greater detail.

Figure 3:
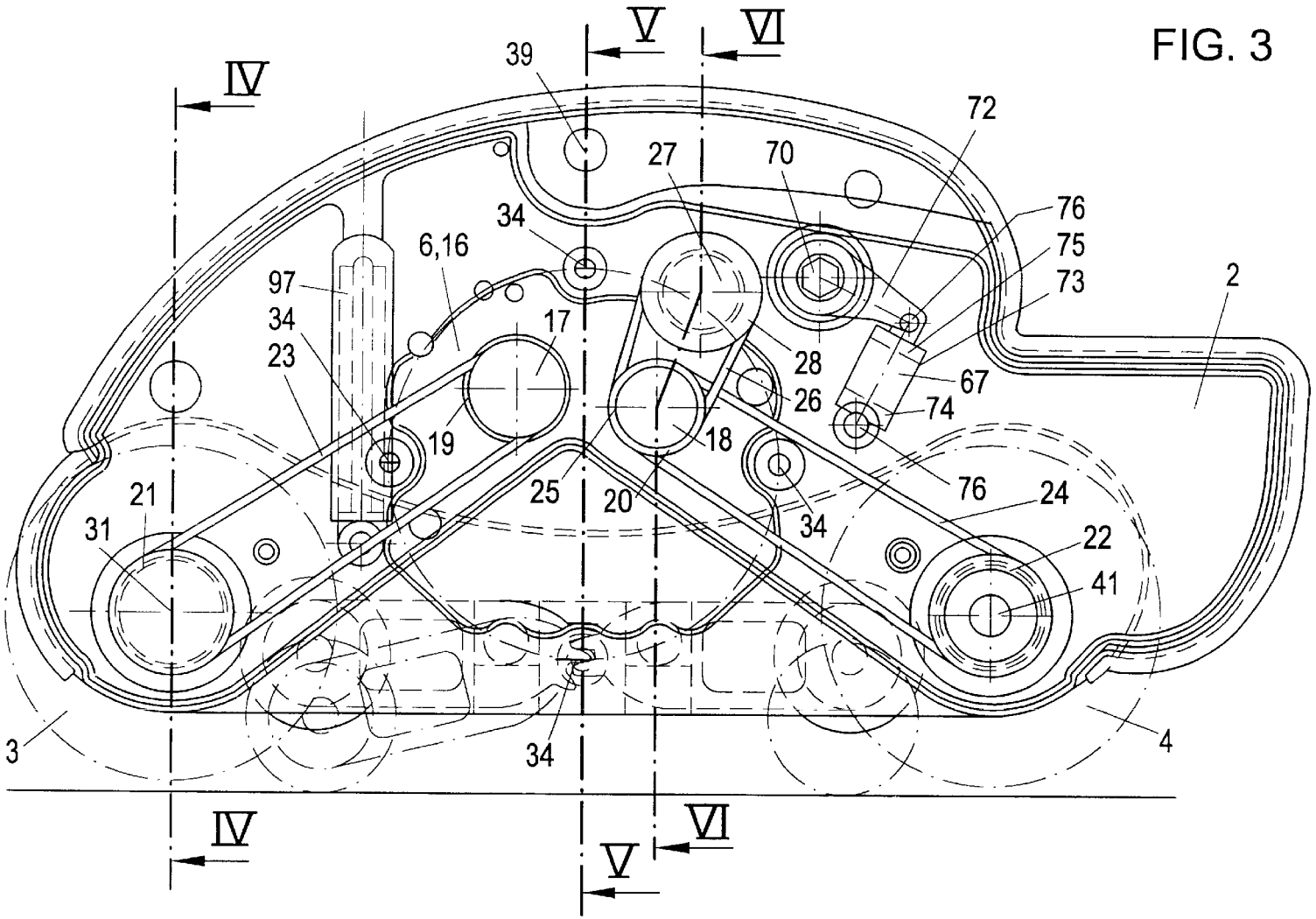
FIG. 3 is a side elevational view of an embodiment of the floor cleaning machine according to the invention.

Referring now to FIG. 3; the cover 12 of the side member 2 is removed to illustrate the drive system according to the invention. Located behind the side member 2 (not visible) is the motor 6 which is connected to a gear mechanism 16. The gear mechanism 16 has two separate driven shafts 17, 18, with driven shaft 17 provided for the cylindrical brush 3, and with driven shaft 18 provided for the cylindrical brush 4. The transfer of a torque from the gear mechanism 16 to the cylindrical brushes 3, 4 is realized by toothed belt drives which include toothed disks 19, 20 secured to the driven shafts 17, 18, toothed disks 21, 22 secured to the shafts 31, 41 of the cylindrical brushes 3, 4, as well as toothed belts 23, 24. The toothed belt 23 connects the toothed disk 19 of the driven shaft 17 with the toothed disk 21 of the cylindrical brush 3 while the toothed belt 24 connects the toothed disk 20 of the driven shaft 18 with the toothed disk 22 of the rear cylindrical brush 4. The toothed disks 19, 20, 21, 22 may be made of any suitable material, preferably, steel, aluminum, plastic or the like.

A further toothed disk 25 that is oriented parallel to the toothed disk 20 is secured on the driven shaft 18. The toothed disk 25 is connected through another toothed belt 26 with a toothed disk 28 that in turn is attached to the driven shaft 27 of the drum 5.

Figure 4:
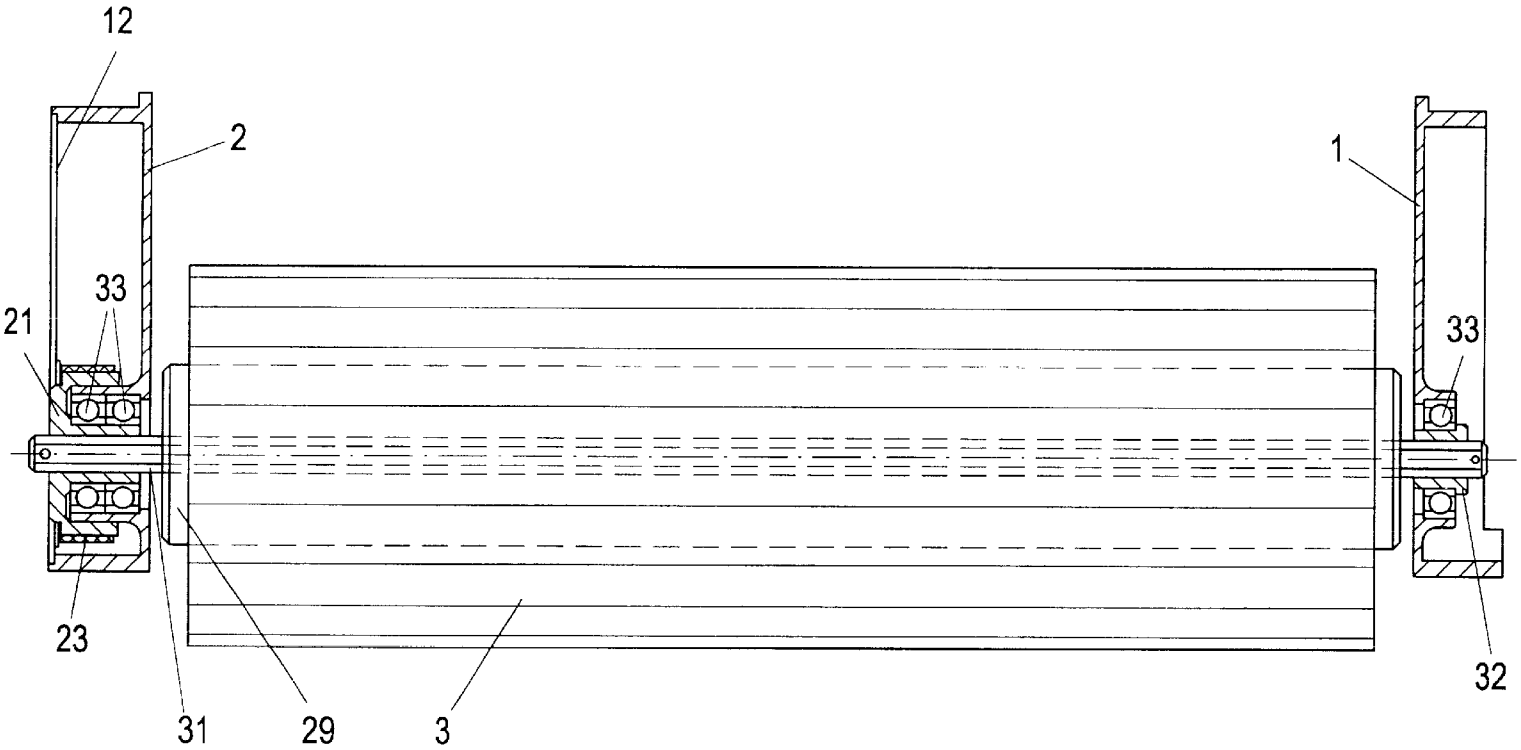
FIG. 4 is a cross-sectional view taken along the line IV—IV of FIGS. 3 and 3*a;*

FIG. 4 shows in detail the arrangement and support of the cylindrical brush 3 in the side members 1, 2. The second cylindrical brush 4 is constructed and supported in the same manner and is therefore not shown in drawing. The cylindrical brush 3 includes a shaft 31 to which a brush hub 29 is attached. The brush hub 29 has bristles that extend radially outwardly. For sake of clarity, the drawing only shows the contours of the brushes 3, 4, but not individual bristles. The shaft 31 projects on both sides beyond the brush hub 29 and extends through the side members 1, 2. The section of the shaft 31, which projects beyond the side member 1 shown on the right side of FIG. 4, has a bushing 32 that is rotatably supported in the side member 1 by a ring ball bearing 33. The toothed disk 21 is secured to the left end of the shaft 31 which is in turn supported in the side member 2 by a ring ball bearing 33.

Figure 5:
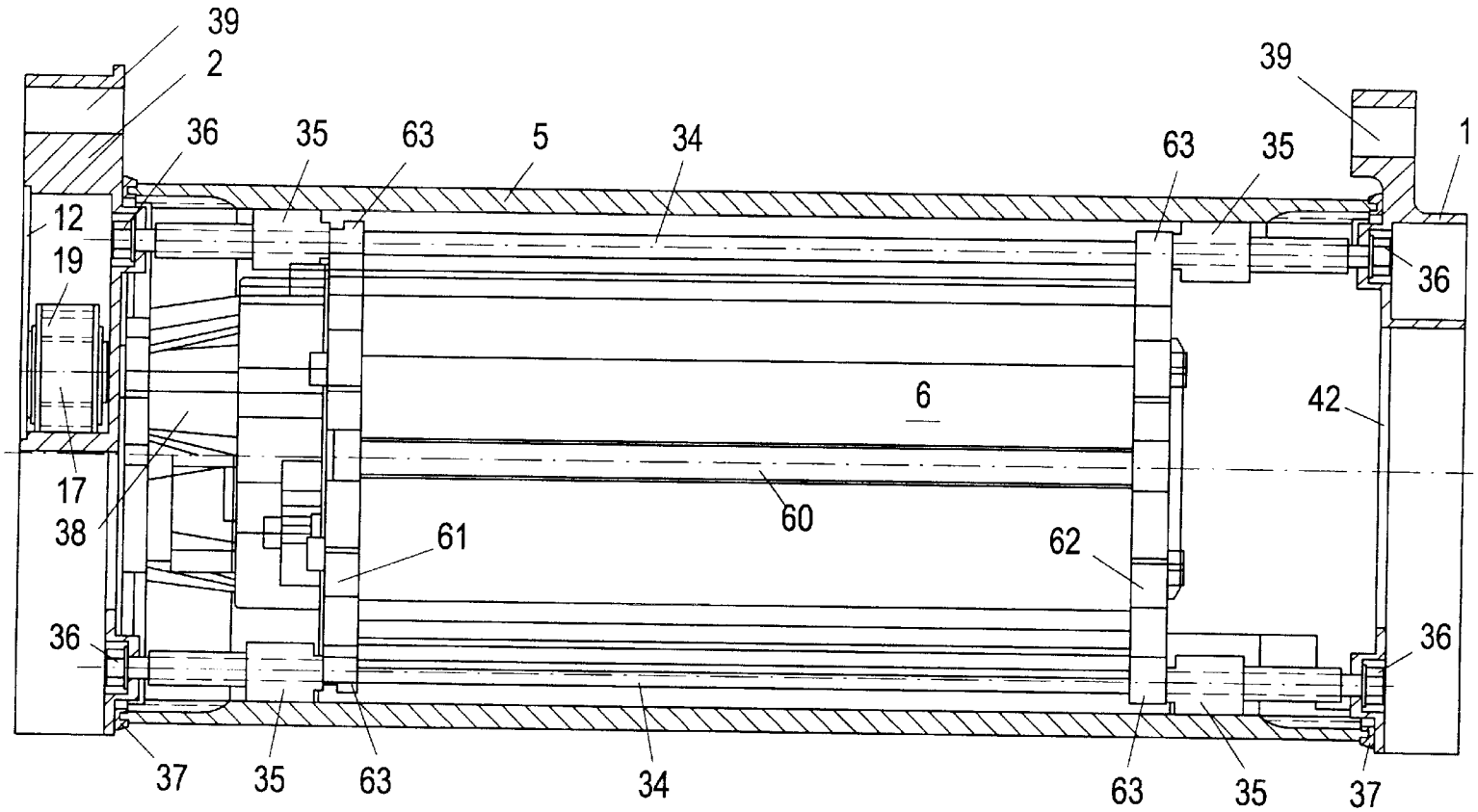
FIG. 5 is a cross-sectional view taken along the line V—V of FIGS. 3 and 3*a;*

Ring ball bearings 33 are preferred because of their low friction; however, other suitable bearing means, such as roller bearings, friction bearings and the like, can also be used. FIG. 5 shows the support for the drum 5 and also the arrangement and installation of the motor 6. Also indicated are the two side members 1, 2 and the cover 12. The side members 1, 2 are connected with each other through rods 34, wherein each of the ends of the rods 34 is secured to the side members 1, 2 with a machine screw 36. Rollers 35 are arranged on the rods 34, wherein the running surfaces of the rollers 35 contact the inner surface of the drum 5 to rotatably support the drum 5. As seen in FIG. 3, the rods 34 and the rollers 35 are not only provided in the 12 o'clock and 6 o'clock positions described above, but also in the 9 o'clock and 3 o'clock positions, so that the drum 5 is guided at four angular locations that are offset from each other by 90°.

Sealing collars 37 which seal against the side members 1, 2 to exclude water from the inside of the drum 5, are secured to both end faces of the drum 5. The motor 6 and its two mounting flanges 61, 62 are shown only as contour lines for sake of clarity. The rods 34 extend through bores 63 of the mounting flanges 61, 62 to provide a fixed rotative engagement between the motor stator and the side members 1, 2. Located adjacent to the side member 2 is the housing 38 of the gear mechanism 16. Also shown are the driven shaft 17 of the gear mechanism 16, and the toothed disk 19 mounted on the driven shaft 17 as well as the motor driven shaft 60. As shown on the right hand side of FIG. 5, a rotor fan 46 is attached to the end face of the motor 6 (see also FIG. 7). The mounting flange 62 is provided with a corresponding opening 47 to enable the rotor fan 46 to draw in fresh air. In addition, a further opening 42 is provided in the side member 1 for supply of cooling air. Bores 39 adapted to receive a handle 10 are provided in the upper ends of the side members 1, 2.

Figure 5A:
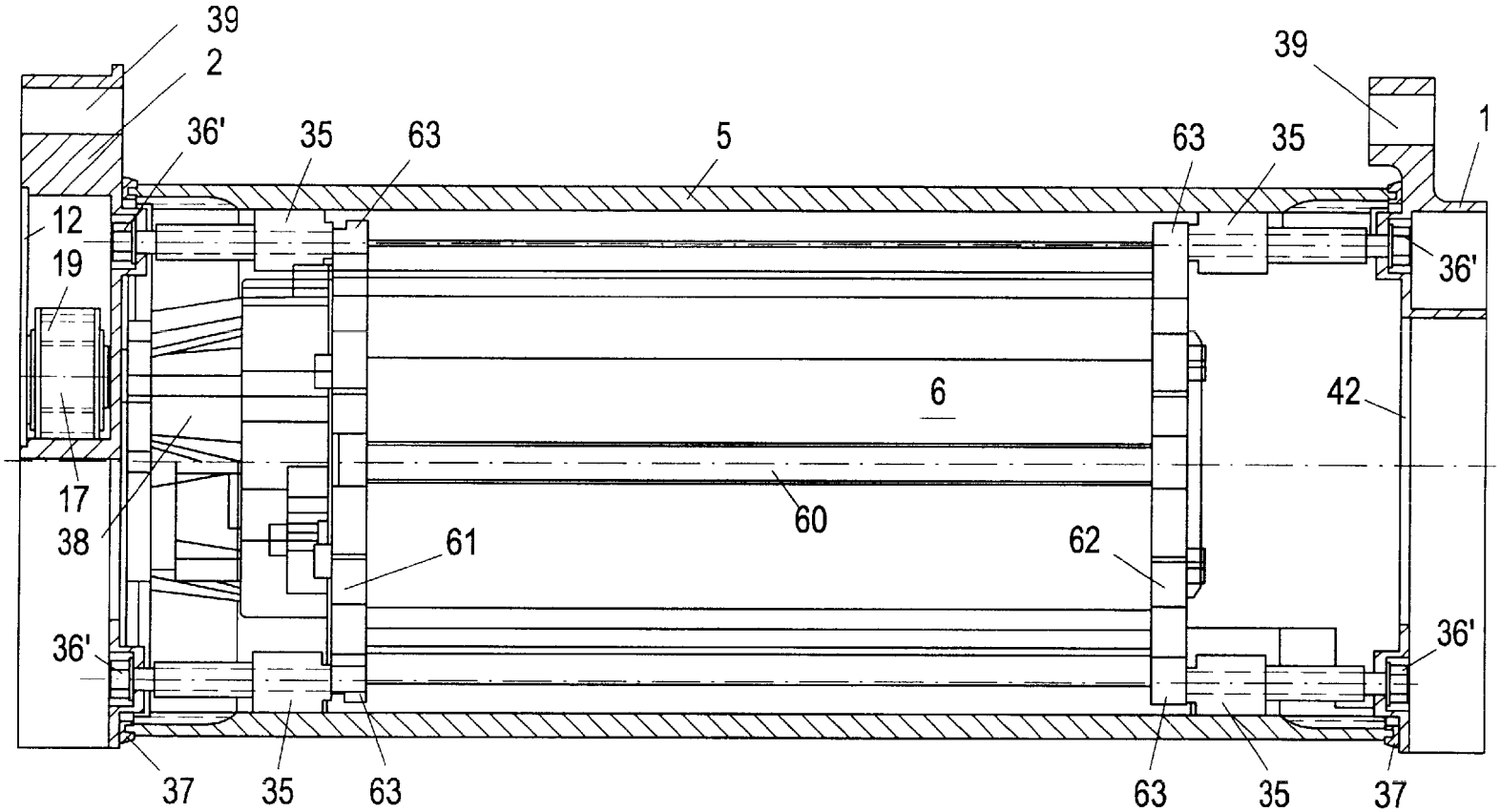
FIG. 5*a* is identical to FIG. 5, except that the motor is attached differently to the side members.

Referring now to FIG. 5*a,* the motor 6 can be secured in fixed rotative engagement to the side members 1, 2 by tension bolts 36' instead of the rods 34 and the machine screws 36. The tension bolts 36' are slightly longer than the machine screws 36 and provided in the positions of the machine screws 36. For this purpose, interior threads adapted to engage with the tension bolts 36' are provided in the bores 63 of the mounting flanges 61, 62. The rollers 35 supporting the drum 5 are rotatably supported on the tension bolts 36'.

Figure 6:
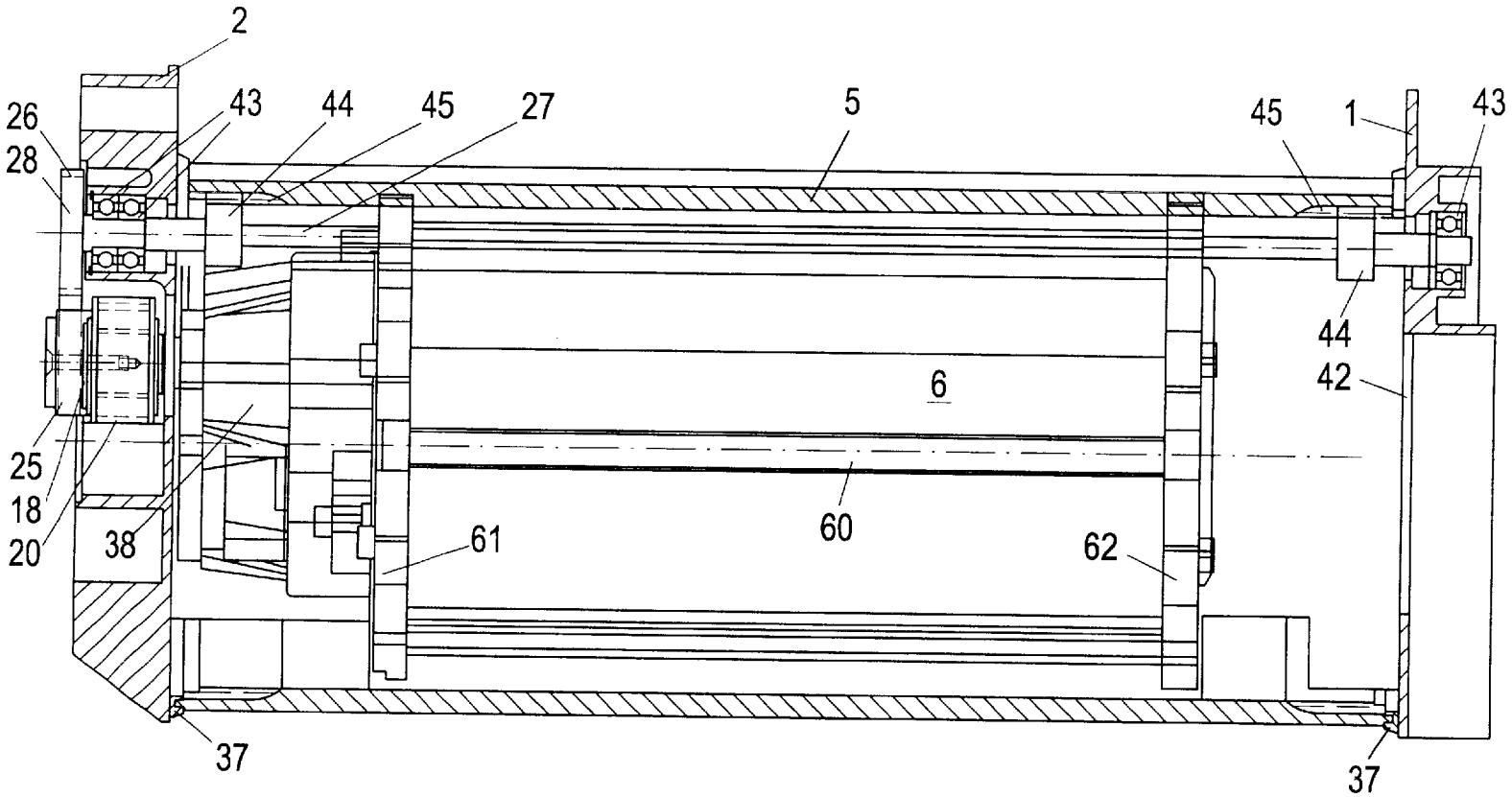
FIG. 6 is a cross-sectional view taken along the line VI—VI of FIGS. 3 and 3*a;*

Reference is made to FIG. 6 for a more detailed description of the drive for the drum. The drum drive shaft 27 is arranged approximately at the 1 o'clock position of the drum 5 (see also FIG. 3). The drum drive shaft 27 extends over the entire width of the drum 5 and projects beyond the side members 1, 2. Ball bearings 43 rotatably support the drum drive shaft 27 in the side members 1, 2. A toothed disk 28 is secured to the end of the drive shaft 27 shown on the left hand side of FIG. 6. The toothed disk 28 is in driving connection via the toothed belt 26 with the toothed disk 25 that is secured on the driven shaft 18 of the gear mechanism 16. A respective drive pinion 44, which is in mesh with an interior gear 45 located on the inside surface of the drum 5, is secured to the drive shaft 27 on the inside of and in close proximity to each of the two end faces of the drum 5. Since the circumference of the drum 5 is significantly larger than the circumference of the drive pinion 44, the rotation speed of the drum 5 is lower than the rotation speed of the cylindrical brushes 3, 4.

Figure 7:
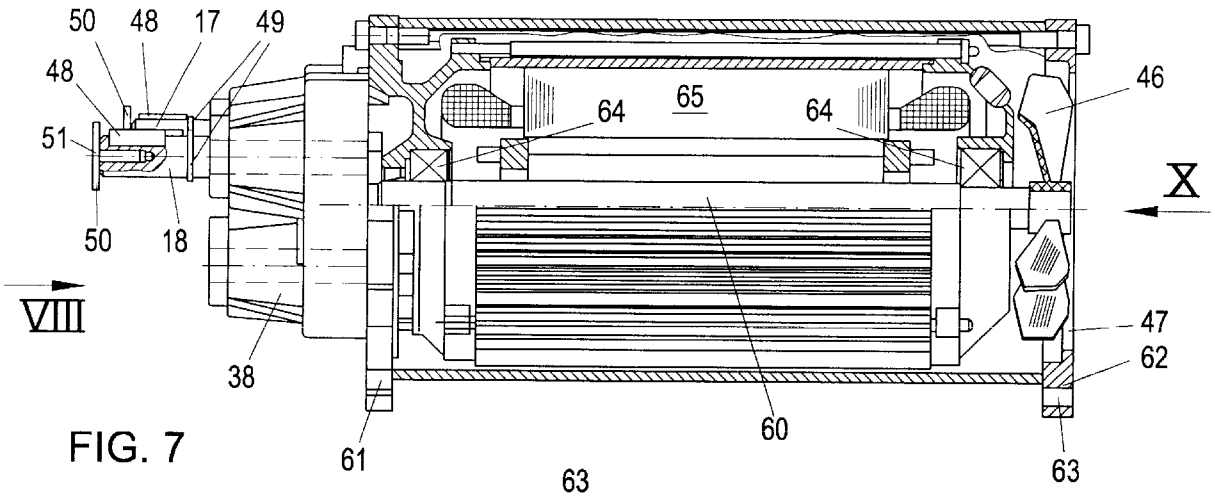
FIG. 7 is a partial vertical cross-section of the motor with attached gear.
Figure 10:
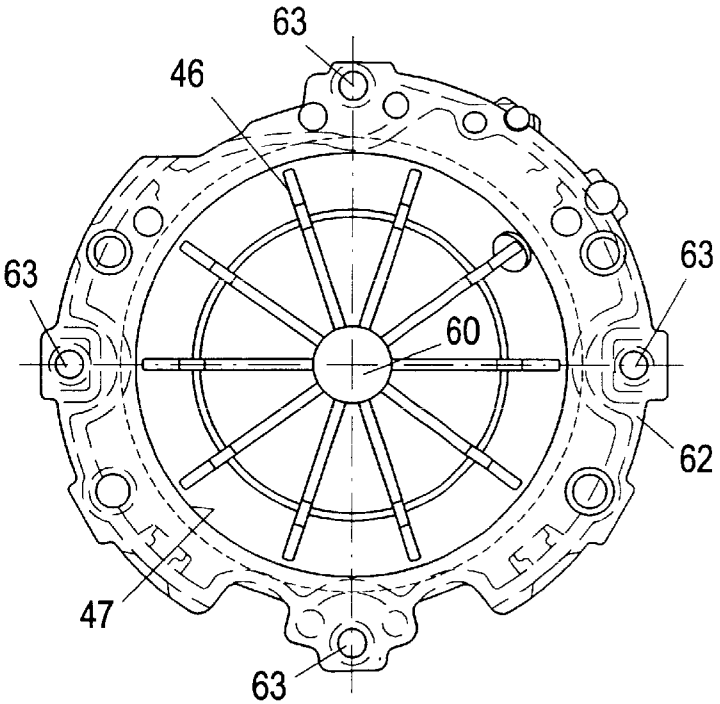
FIG. 10 is a side elevational view of the motor in the direction indicated by arrow X in FIG. 7.

The construction of the motor 6 and the interconnected gear mechanism 16 will now be described with reference to FIGS. 7 to 10. FIG. 7 shows a partial cross-section of the motor 6 with the motor mounting flanges 61, 62 and the gear mechanism 16 (only the gear housing 38 is shown), before the motor 6 is installed in the cleaning machine. Also illustrated on the right hand side of FIG. 7 and also in FIG. 10 is the rotor fan 46 attached to the motor driven shaft 60 and the opening 47 for the fresh air supply. The rotor package 65 is connected to the shaft 60 with an adhesive, with both ends of the shaft 60 being supported in the stator via ball bearings 64.

The motor 6 may be an electric motor of any suitable type, for example a DC motor or an asynchronous motor. Preferred, however, is a synchronous motor. Regardless of the selected motor type, an electronic rotation speed controller is provided for the motor 6. The rotation speed controller can be used to adjust the optimal rotation speed for the brushes and the drum 5 for the selected floor type at hand and to provide a smooth start-up of the drive when the motor 6 is switched on. In particular, a high rotation speed can be attained with a synchronous motor, so that the floor cleaning machine according to the invention can also be used to wax floors, in particular marble floors.

Also illustrated in FIG. 7 is the attachment of the toothed disks 19, 20, 25 to the driven shafts 17, 18 are attached. Inserted in the driven shafts 17, 18 are springs 48 which engage in complementary recesses provided in the toothed disks 19, 20 to prevent a rotation of the toothed disks 19, 20, 25 with respect to the driven shafts 17, 18. To prevent the toothed disks 19, 20, 25 from moving in the longitudinal direction of the driven shafts 17, 18, Seeger or circlip rings are secured on the outside surfaces of the driven shafts 17, 18, whereas the disks 50 are secured on the driven shafts 17, 18 with screws 51 that extend into the driven shafts 17, 18.

The second driven shaft 18 which drives the cylindrical brush 4 and also the drum 5, is longer than the first driven shaft 17 and has two toothed disks 20 and 25 arranged side-by-side for driving to brush 4 and the drum 5.

Figure 8:
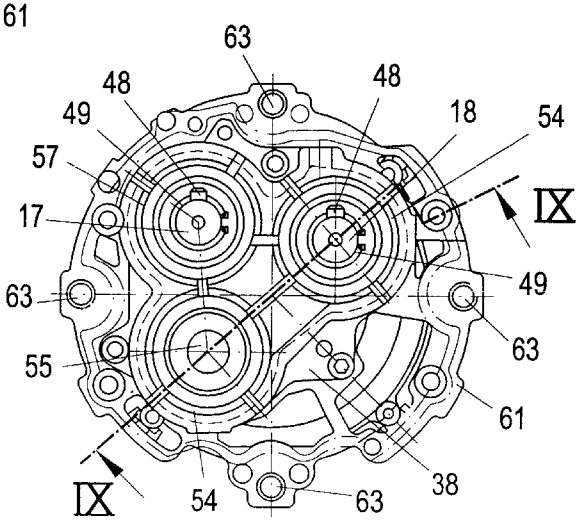
FIG. 8 is a side elevational view of the motor in the direction indicated by arrow VIII in FIG. 7.
Figure 9:
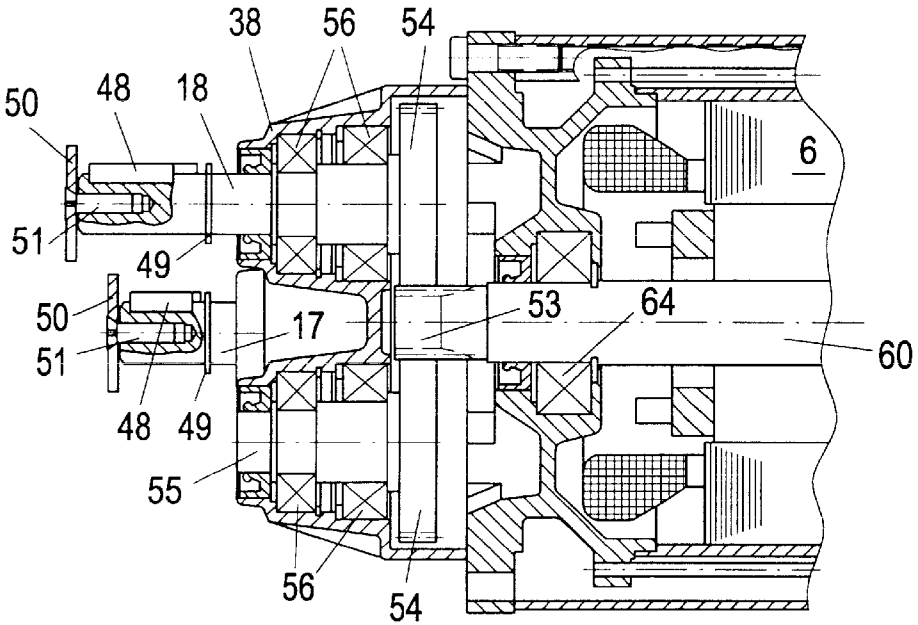
FIG. 9 is a cross-sectional view of the motor, taken along the line IX-IX in FIG. 8.

The arrangement of the gear mechanism 16 is illustrated in FIGS. 8 and 9. The gear mechanism 16 includes a pinion 53 secured to the motor driven shaft 60 and two primary gear wheels 54 engaging the pinion 53. The upper primary gear wheel 54 is directly secured to the second driven shaft 18, whereas the second primary gear wheel 54 is secured to a shaft 55 that does not extend to the outside.

Like the first driven shaft 17 which is not illustrated in FIG. 9, the second driven shaft 18 and the shaft 55 are also supported in the housing 38 of the gear mechanism 16 by two ball bearings 56. In addition, a secondary gear wheel 57 is provided which engages the lower primary gear wheel 54. The secondary gear wheel 57, which is not visible in the particular cross-section of FIG. 9, is secured to the first driven shaft 17. The specific spatial arrangement of the three gear wheels 54, 57 of the gear mechanism 16 is illustrated in detail in FIG. 8. The gear wheels 54, 57 are not visible in FIG. 8 since they are covered by the housing 38. However, to provide a better understanding of the gear design, the caps of the housing 38 that cover the gear wheels 54, 57, show the respective reference numerals of these gear wheels.

With this gear wheel configuration, the second driven shaft 18 is directly driven by the pinion 53, whereas the first driven shaft 17 is only indirectly in driving relationship with the pinion 53 via the second primary gear wheel 54. By connecting the primary gear wheel 54 between the motor pinion 53 and the driven shaft gear wheel 57, the driven shafts 17, 18 rotate in opposite directions, as indicated by the arrows in FIG. 8.

The pinion 53, the primary gear wheels 54 and the secondary gear wheel 55 can be made of any suitable material; however, spur gears made of steel are preferred because of their long service life. A helical structure can also be advantageously employed for the pinion gear 53 and the primary gear wheel 54 and secondary gear wheel 55.

Figure 12:
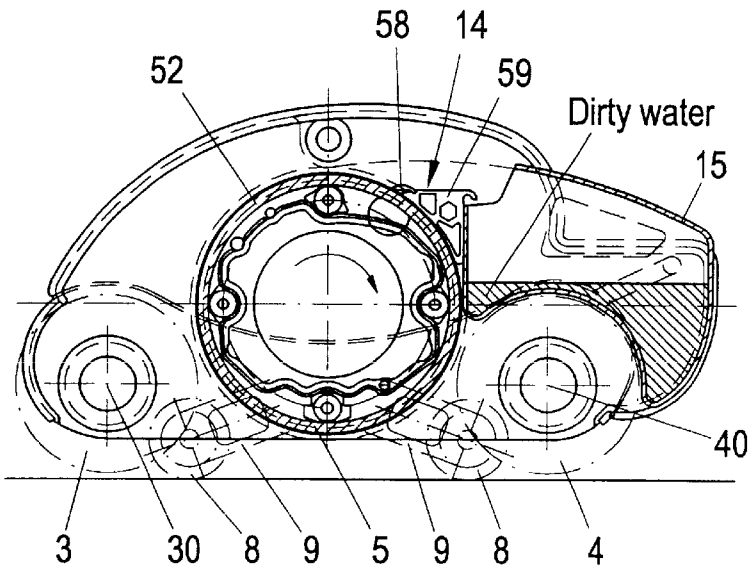
FIG. 12 is a cross-sectional view taken along the line XII—XII of FIG. 11.
Figure 11:
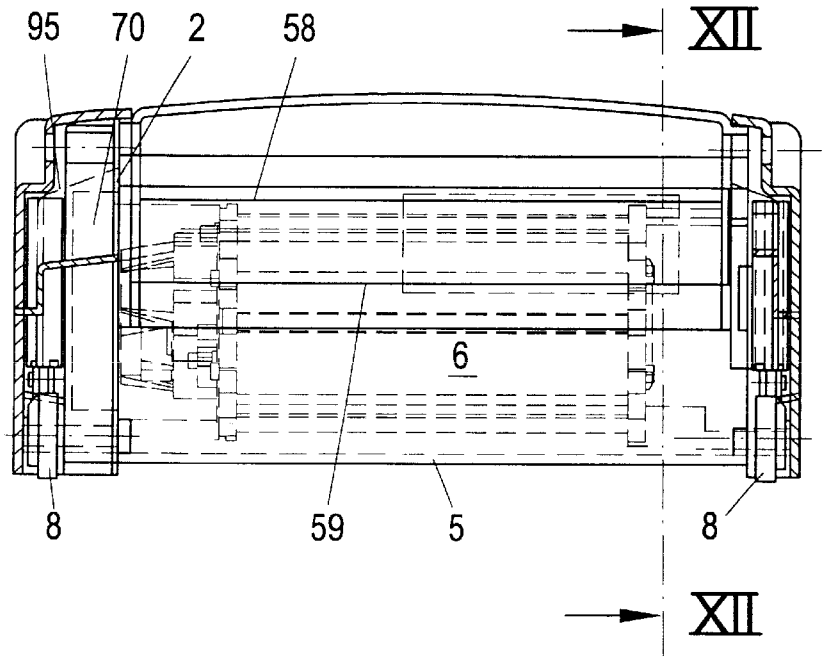
FIG. 11 is a side elevational view of the floor cleaning machine of the invention according to FIG. 12.

The stripping device 14 according to the invention will now be described. As illustrated in FIGS. 11 and 12, the stripping device 14 has a strip 58 that extends across the entire width of the drum 5 and contacts the outer surface of the drum 5. The strip 58 is preferably made of steel and thus not very flexible; However, the strip 58 may also be designed instead as an elastic rubber strip (similar to a windshield wiper blade). Also provided is a rigid strip holder 59 that extends essentially over the entire length of the strip 58. The strip 58 lifts the soiled water film 52 from the surface of the drum 5 for transfer to the strip holder 59, from where the water film 52 is transferred to the wastewater container 15. Basically, the strip holder 59 needs only be in form of a strip, as long as it is able to hold the strip 58 across the entire length thereof.

Figure 14:
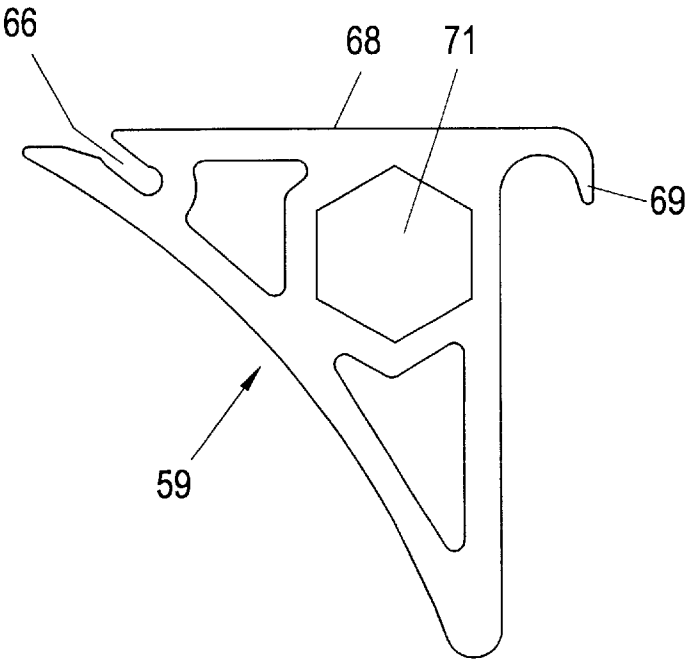
FIG. 14 is a front face of the strip holder according to FIGS. 12 and 13.
Figure 13:
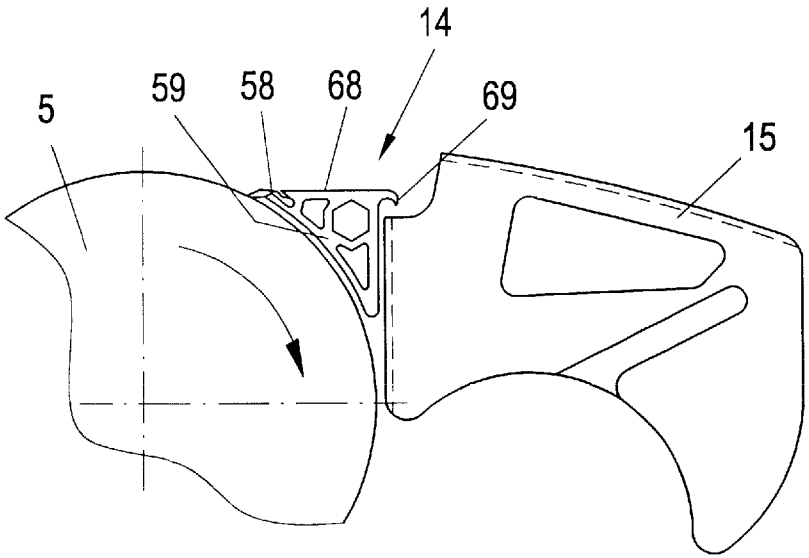
FIG. 13 is a detailed top elevational view of a first embodiment of a stripping device according to the invention.

As seen in particular in FIGS. 13 and 14, the strip holder 59 advantageously has an approximately triangular profile provided with a slot 66 adapted to clamp the strip 58. The slot 66 terminates in a surface 68, which—when installed—is oriented horizontally or tilted slightly towards the wastewater container 15, for removing the wastewater film 52. The surface 89 terminates in a drip edge 69 of the strip holder 59, with the drip edge 69 projecting over the side wall of the wastewater container 15 so as to direct wastewater to the wastewater container 15. To lift the water film 52 from the drum surface, the strip 58 is biased against the drum surface by at least one spring 67 which pushes the strip holder 59 towards the drum surface. The spring 67 may be arranged directly on the strip holder 59 or, alternatively, on an auxiliary strip extending parallel to the strip holder 59 so as to displace the strip holder 59 in the direction of the drum surface.

Advantageously, the strip holder 59 may be pivotally supported, and the spring 67 may be arranged so as to pivot the portion of the strip holder 59 that carries the strip 58 in the direction of the drum surface. This pivotal support can be attained by providing each side face of the strip holder 59 with a stub, wherein the stubs are pivotally supported in the side members 1, 2. One end of the spring 67 may be supported on the strip holder 59 and the other end on the auxiliary strip extending parallel to the strip holder 59. The strip holder 59, however, is preferably in fixed rotative engagement with a pivot shaft 70. In this case, the pivot shaft 70 is preferably a profile in form of a regular hexagon, with a bore 71 that matches the hexagonal profile provided in the strip holder 59. The pivot shaft 70 projects beyond the end faces of the strip holder 59 and is pivotally supported in the side members 1, 2. Any type of pivot support can be used. Since the pivot shaft 70 only performs small movements, it is sufficient to provide the side members 1, 2 with bores and to insert the pivot shaft 70 into these bores without special bearings.

Arranged on at least one end of the pivot shaft 70, that projects over a side members 1, 2, is a lever 72, with at least one spring 67 acting on the lever 72. This situation is illustrated more clearly in FIG. 3. The spring-lever arrangement, discussed above, is duplicated for the side member 1 (not shown in FIG. 3). The spring 67 is formed as a compression spring, wherein a first end of the spring 67 is supported on the side member 1, 2 and the second end is supported on the lever 72. The compression spring 67 is housed in a housing 73 that has the form of a hollow cylinder and is closed at one end. The housing 73 is pivotally supported in the side member 1, 2 and is oriented parallel to the side member 1, 2. The first end of the compression spring 67 is supported on the bottom 74 of the housing 73 and the second end thereof is supported on a piston 75 that is pivotally supported on the lever 72 and projects into the housing 73.

The swingable support of the housing 73 on the side member 1, 2, and of the piston 75 upon the lever 72 is realized by a respective axle 76 which is secured to the side member 1, 2 and the lever 72, respectively. The housing 73 and the piston 75, respectively, have a bore surrounding the axles 76. The bore may be replaced by a fork located on the housing 73 and the piston 75, respectively, and bearing upon the axles 76. Forks of this type may have an opening facing away from the spring 67.

Figure 3A:
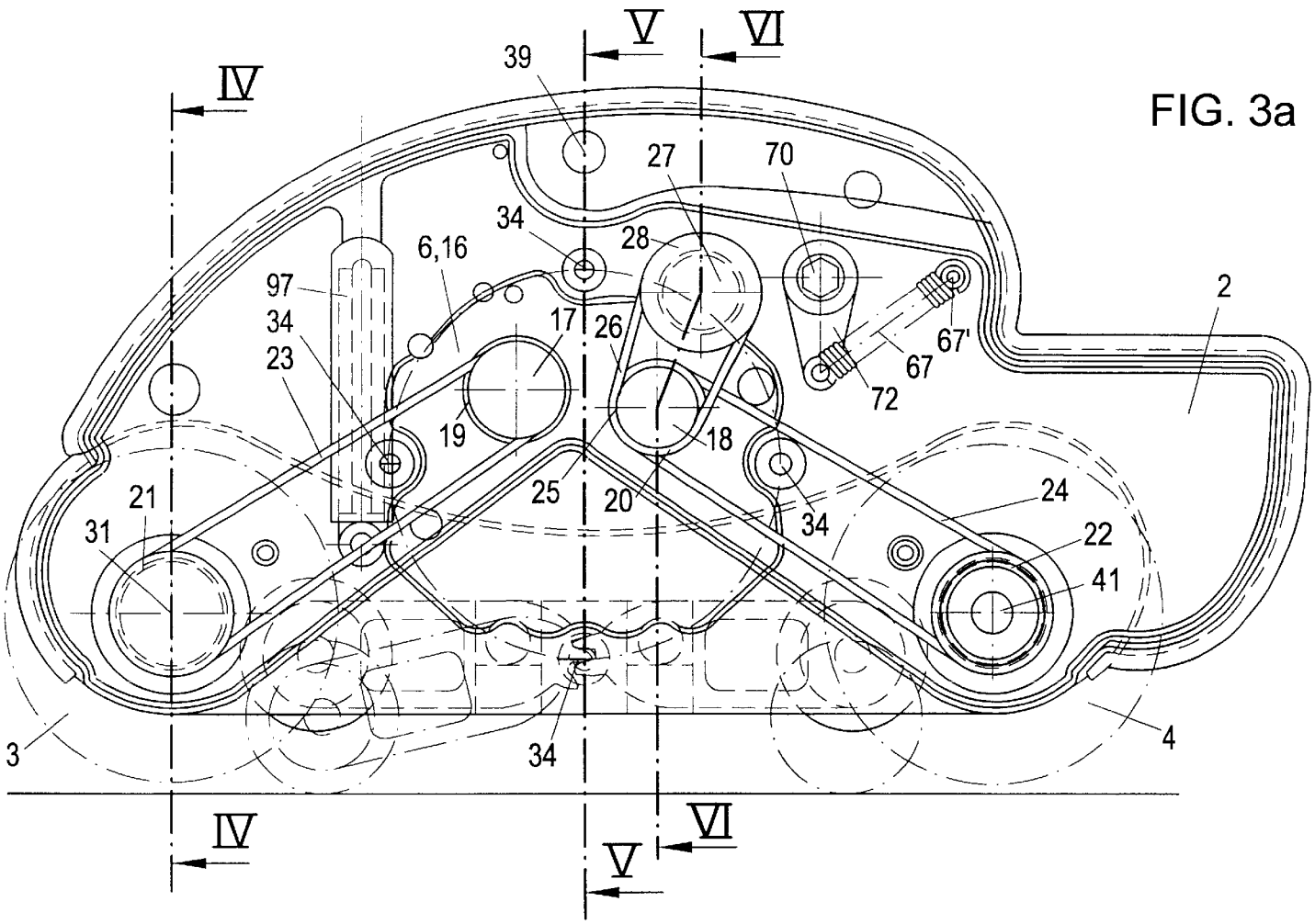
FIG. 3*a* is the machine of FIG. 3, except that a different type of spring is used.

As seen in FIG. 3*a,* the spring 67 can also be formed as a tension spring, with its first end secured to the side member 1, 2 via a bolt 67', and with its second spring end being secured to the lever 72.

Figure 15:
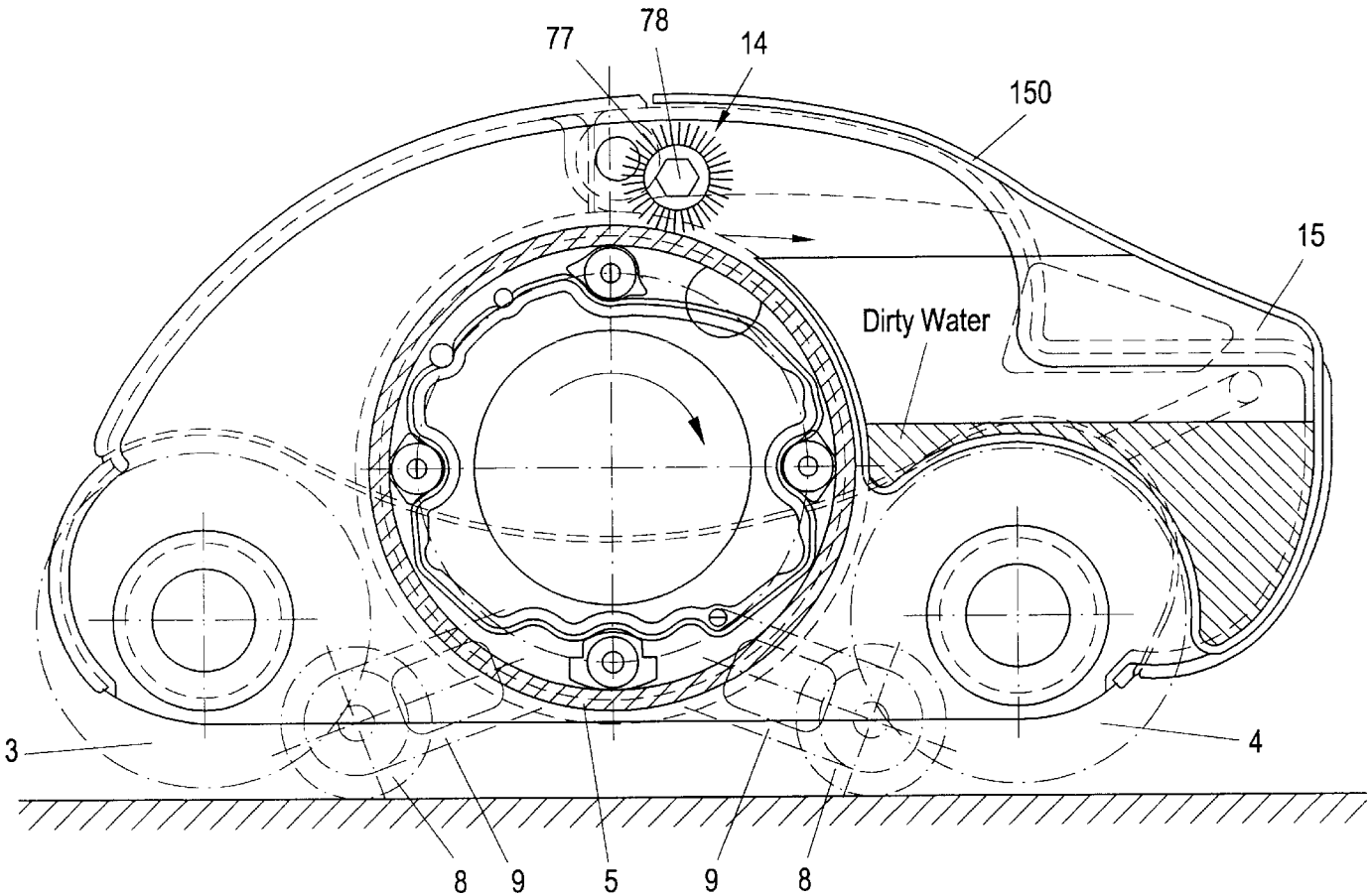
FIG. 15 is a cross-section taken along the line XII—XII of FIG. 11, wherein the floor cleaning machine shown in cross-section is provided with a second embodiment of the stripping device according to the invention.

FIG. 15 shows another embodiment of the stripping device 14 according to the invention. In this case, the water film 52 is not lifted by a strip, but by a rotating cylindrical brush 77 extending essentially across the entire width of the drum 5 and having free bristle ends contacting the drum surface. Similar to the cleaning brushes 3, 4, the cylindrical brush 77 is rotatably supported in the side members 1, 2, preferably by ball bearings. Like the drive of the drum 5, the cylindrical brush 77 is rotatably driven by securing another toothed disk on the driven shaft 17 of the gear mechanism 16, with the disk being in driving relationship via a toothed belt with a toothed disk secured to the shaft 78 of the cylindrical brush 77.

The rotating cylindrical brush 77 lifts the soiled water film from the surface of the drum 5 and at the same time propels the film in the direction of the waste container 15 (indicated by the arrow in FIG. 15). In order to direct the so produced soiled water mist completely into the waste container 15, the container 15 is slightly modified compared to the configuration illustrated in FIGS. 11 to 14. In particular, the container 15 includes a catch plate 150 that extends over the actual container 15 and the cylindrical brush 77.

Although the stripping device 14 according to the invention is described only in conjunction with a floor cleaning machine of a type including includes two counter-rotating cylindrical brushes 3, 4, the same stripping device 14 can also be employed with other types of cleaning machines that include at least one rotating brush and a rotating drum 5, which has a water film 52 adapted to receive the dirt removed by the brush. With this arrangement, the soiled water film 52 can be lifted from the drum 5 and transferred to a waste water container 15.

The floor cleaning machine according to the invention can be moved with a handle 10 that is arranged on the upper ends of the side member 1, 2. A floor cleaning machine provided with a handle 10 of this type is illustrated schematically, by way of an overview, in FIGS. 16*a–c.* The configuration of the handle 10 will now be described in more detail with reference to FIGS. 17 and 18. The handle 10 has a center section 79, a grip 80 in the form of a looped strap which is provided on the upper end of the handle 10, and a fork 81 which is provided on the lower end of the handle 10 and has two legs 82. The free ends of the legs 82 of the fork 81 are supported on the side members 1, 2 of the floor cleaning machine by machine screws which traverse bores 83 provided in the fork ends and bores 39 provided in the side members 1, 2.

A pump switch 109 which is used to turn the pump 92 (see FIG. 1) on and off to apply fresh water to the floor to be cleaned or to the first cylindrical brush 3, is secured on the grip 80.

Figure 21:
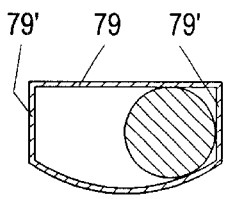
FIG. 21 is a cutaway view taken along the line XXI—XXI in FIG. 18.

The center section 79 of the handle 10 is formed as a hollow profile, as shown in FIG. 21. In this way, at least portions of the electrical components controlling the operation of the motor 6, such as speed adjustment, capacitor 84 and the like, can be arranged inside the handle 10 and thus protected from the environment. The form of the handle 10, however, is not essential for the invention, and the center section can have the form of a simple rod.

A switch 86 is provided to switch the motor 6 on and off. The motor 6 may be a single phase AC motor, with a respective switch 86 being arranged in each of the main power wires. The two switches 86 are stationary and arranged in the upper end of the center section 79 of the handle 10. In addition, the handle 10 has a lever 85 that is pivotally supported on the upper end of the center section 79. According to the invention, the switch 86 can be activated with this lever 85. The lever 85 may be a simple rod, with a first end of the rod pivotally secured to the handle 10. The actuating elements 87 of the switch 86 would thus have to be arranged inside the rotation path of the lever 85 so as to be able to make contact with the lever 85.

Figure 18:
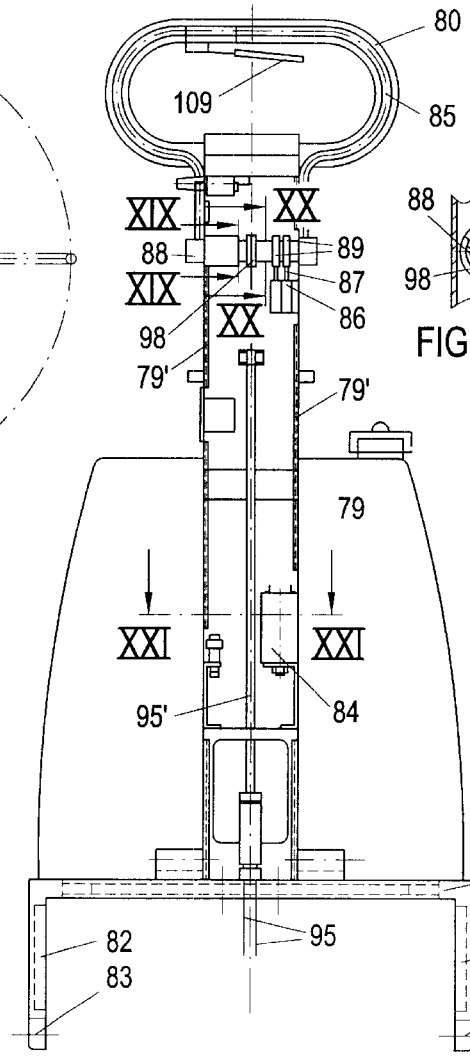
FIG. 18 is a schematic illustration of the handle as illustrated in FIG. 16*b;*
Figure 20:
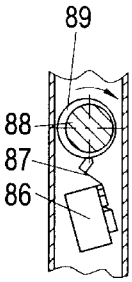
FIG. 20 is a cutaway view taken along the line XX—XX in FIG. 19.

As shown, for example, in FIG. 18, the lever 85 may be in the form of a loop (for example, in the shape of the grip 80) and provided with a pivot shaft 88 supported on the handle 10. The pivot shaft 88 extends fully through the profile of the center section 79 and is supported in bores disposed in the side walls 79'. Each switch 86 has a respective actuator 89 located on the pivot shaft 88, with the actuating element 87 of the switch 86 being arranged on the handle 10 and located in the rotation path of the actuator 89. The actuators 89 may have the form of cams; in a preferred embodiment, however, the actuators 89 are implemented in the form of cylindrical disks that are eccentrically secured on the pivot shaft 88, as illustrated in FIG. 20. The switches 86 are in the form of microswitches, and the actuating element 87 is a lever.

Figure 17:
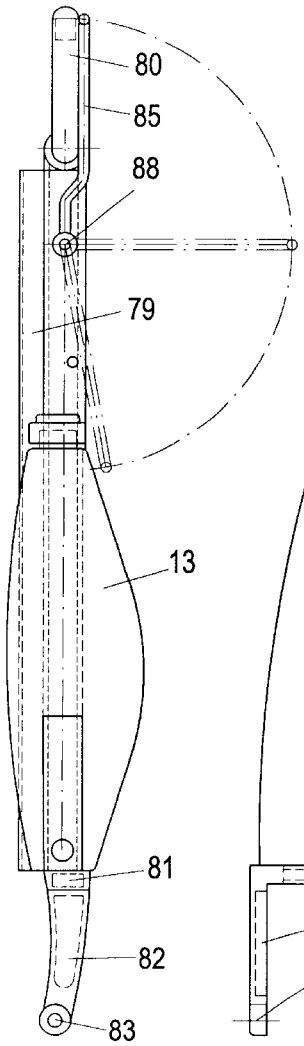
FIG. 17 is a schematic illustration of the handle as illustrated in FIG. 16*a;*

In FIG. 18, the lever 85 is shown in the "ON" position, i.e., the switches 86 are closed and the motor 6 is in operation. To turn the motor off, the lever 85 is rotated clockwise downwardly, as shown in FIG. 17. In FIG. 18 this movement would means a swinging of the lever 85 out of the drawing plane. As indicated in FIG. 20 by an arrow, the pivot shaft 88 is rotated clockwise when the lever 85 is actuated, so that the actuating disks 89 rotate to move the switch actuators 87 clockwise into the "OFF" position.

Figure 16C:
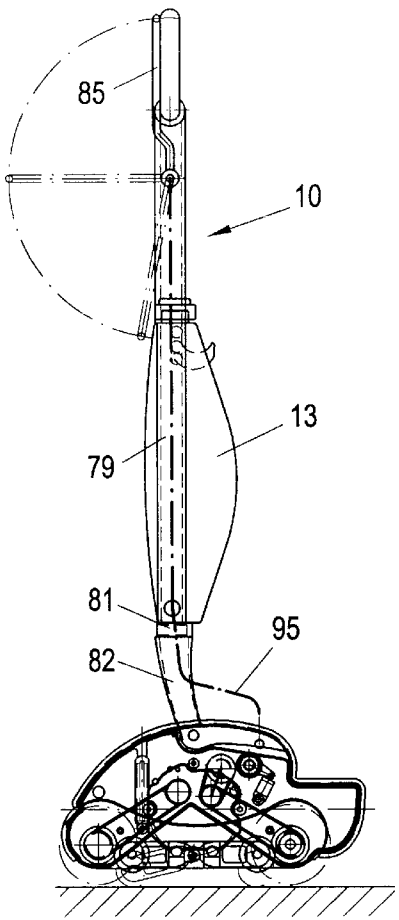
FIGS. 16*a–c* show a left side view, a top view and a right side view of a floor cleaning machine according to the invention, with the directions referring to the top view of FIG. 16*b;*
Figure 16B:
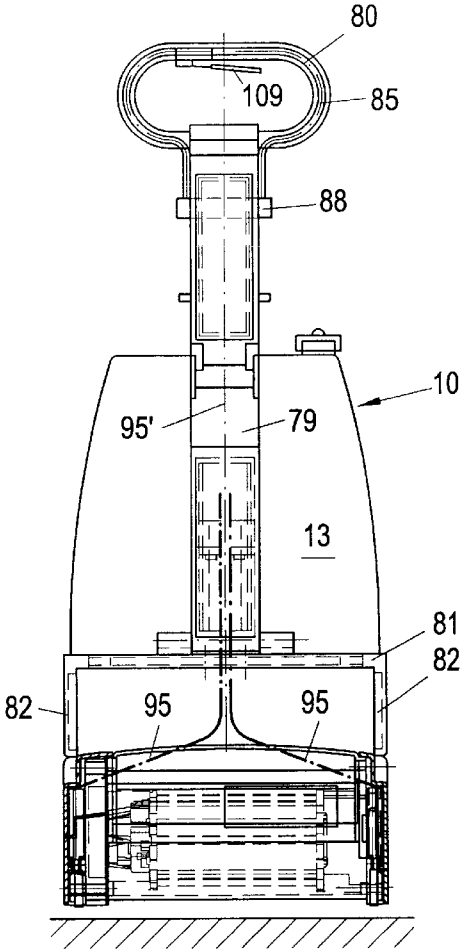
Figure 16A:
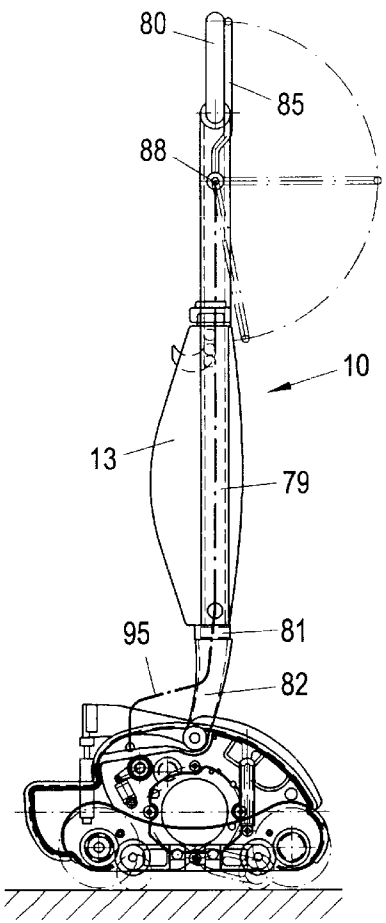
Figure 16F:
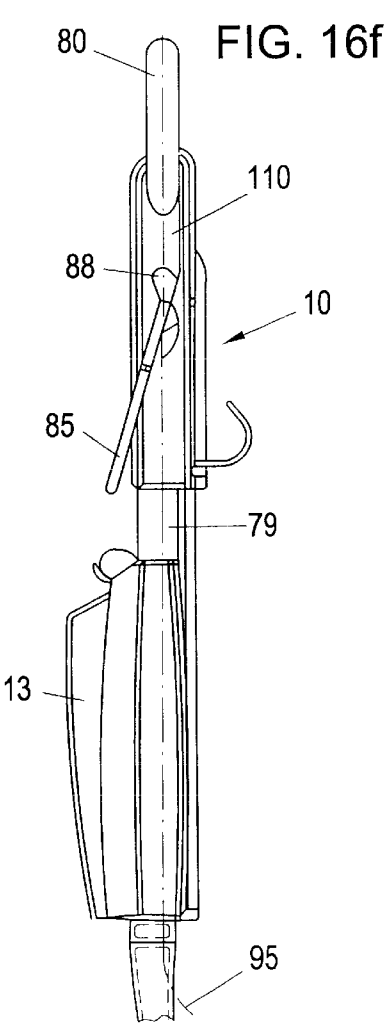
FIGS. 16*d–f* show a handle different from that illustrated in FIGS. 16*a–c;*
Figure 16E:
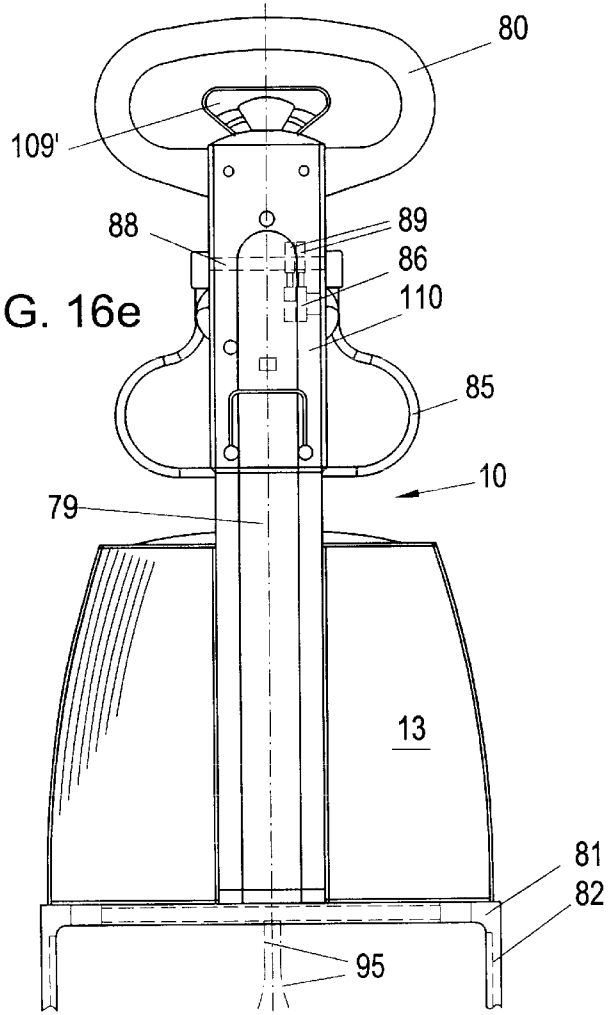
Figure 16D:
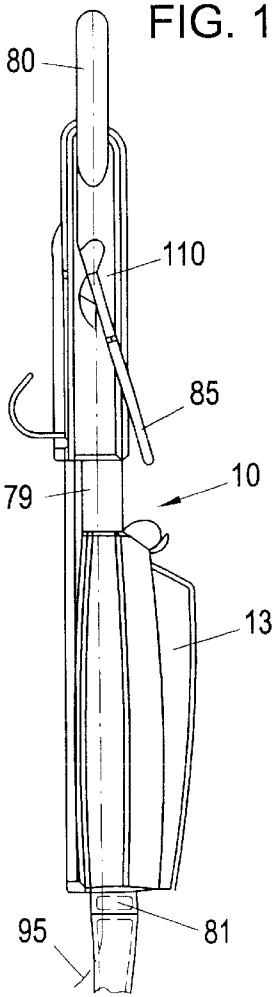

A somewhat different variation of the handle 10 is illustrated in FIGS. 16*d–f*. The handle 10 has, in addition to the center section 79, a housing 110 that is moved over the center section 79 and fixedly connected to the upper portion of the center section 79. Accordingly, the housing 110 should be considered as part of the handle 10. The housing 110 is adapted to accommodate all electrical/electronic components and assemblies that operate the motor 6, for example, the protective motor switch 116, the capacitor 84, the switch 86, the electronic speed controller and the like, and protect these components from the water spray. Moreover, the main power connection 117 is also located in the wall of the housing 110. The housing 110 also supports the pivot shaft 88 of the lever 85. The switches 86 and the associated actuators 89 are arranged inside the housing 110 as shown in FIGS. 18 to 21 (cf. FIGS. 17*a* to 20*a*). The motor 6 can then be switched on and off in the manner described above.

Another difference between the handle 10 according to FIGS. 16*a–c* and the handle according to FIGS. 16*d–f* is the arrangement of the pump switch 109: In FIGS. 16*d–f*, the pump switch 109 is arranged inside the housing 110, with the operating lever 109' being attached to the upper end of the housing 110, whereas in FIGS. 16*a–c* the pump switch 109 is attached to the grip 80.

Although the handle 10 according to the invention is described only with reference to a cleaning machine as illustrated in the drawings, i.e. a cleaning machine with two counter-rotating cylindrical brushes 3, 4, the same handle 10 can also be employed with other floor cleaning machines that have a motor 6, preferably an electric motor, for driving cleaning devices implemented as cylindrical brushes 3, 4, as well as at least one switch 86 for switching the motor 6 on and off, wherein the switch 86 can be actuated by a portion of the handle 10, more particularly by the lever 85.

As mentioned above, an undercarriage is attached to the side members 1, 2 of the floor cleaning machine illustrated in the drawing. The undercarriage includes four wheels 8 supported in wheel supports 9 that are movable relative to the cylindrical brushes 3, 4. The wheel supports 9 are formed as levers, with the wheels 8 supported on one ends of the levers. The second ends of the wheel supports 9 are pivotally secured to the side members 1, 2 of the floor cleaning machine. As shown more particularly in FIGS. 22 and 23, the wheel supports 9 can be rotated into two positions. In the first position of the wheel supports 9 illustrated in FIG. 23, the wheels 8 are lifted above the section of the cylindrical brushes 3, 4 so that the brushes 3, 4 make contact with the floor. The floor can then be cleaned. In the position illustrated in FIG. 22, the wheels 8 are lowered below the section of the cylindrical brushes 3, 4 that contact the floor. The floor cleaning machine then rests on the wheels 8 and the cylindrical brushes 3, 4 are lifted from the floor. In this position of the wheel supports 9, the floor cannot be cleaned, but the floor cleaning machine can now be easily moved.

Cables 95 are provided to move the wheel supports 9 in the manner described above; whereby a first end of the cables 95 is secured to the first ends of the wheel supports 9 distal from the second ends of the wheel supports 9. By pulling the cables 95 in the direction of the arrow shown in FIG. 22, the wheel support 9 can be moved into the position according to FIG. 23.

Figure 22:
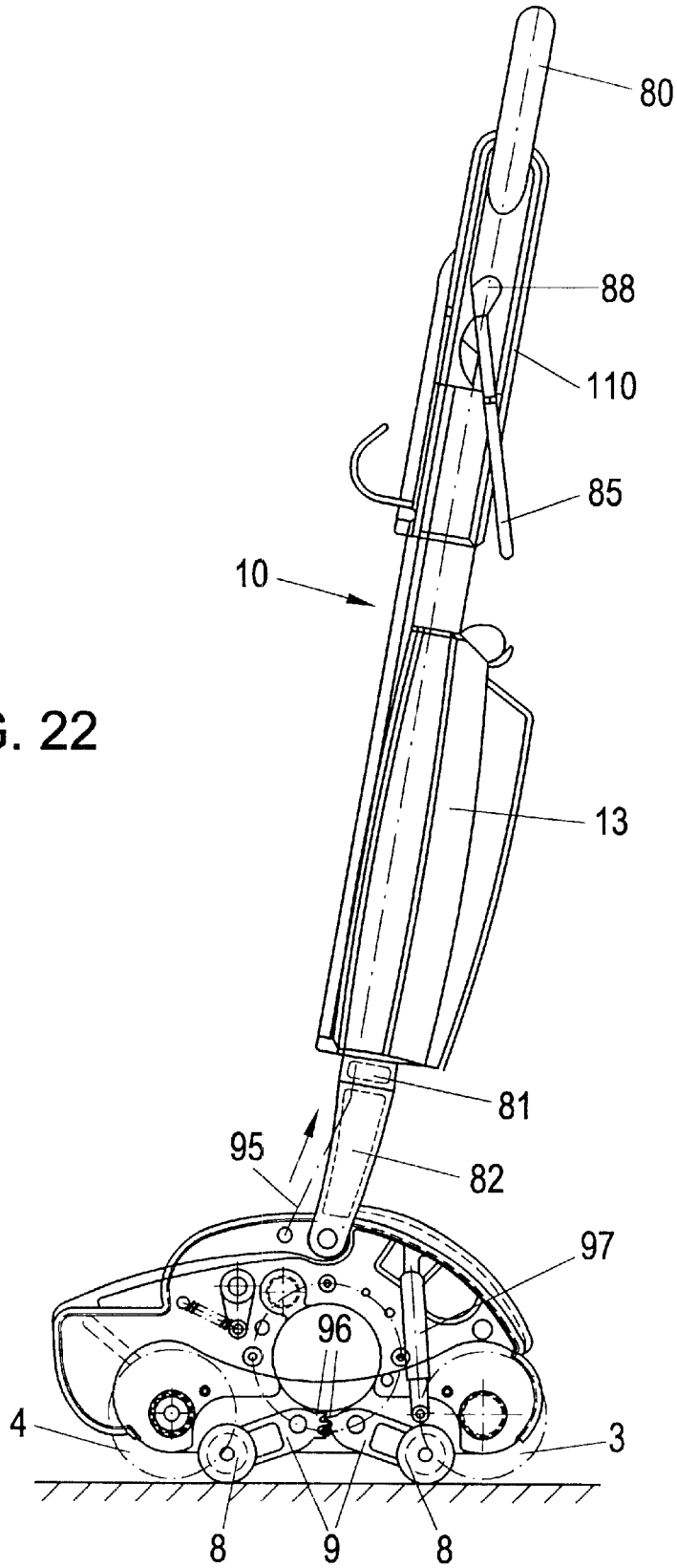
FIGS. 22 and 23 show a side elevational view of the same floor cleaning machine provided with an undercarriage of the invention in a raised and a lowered position, respectively.
Figure 23:
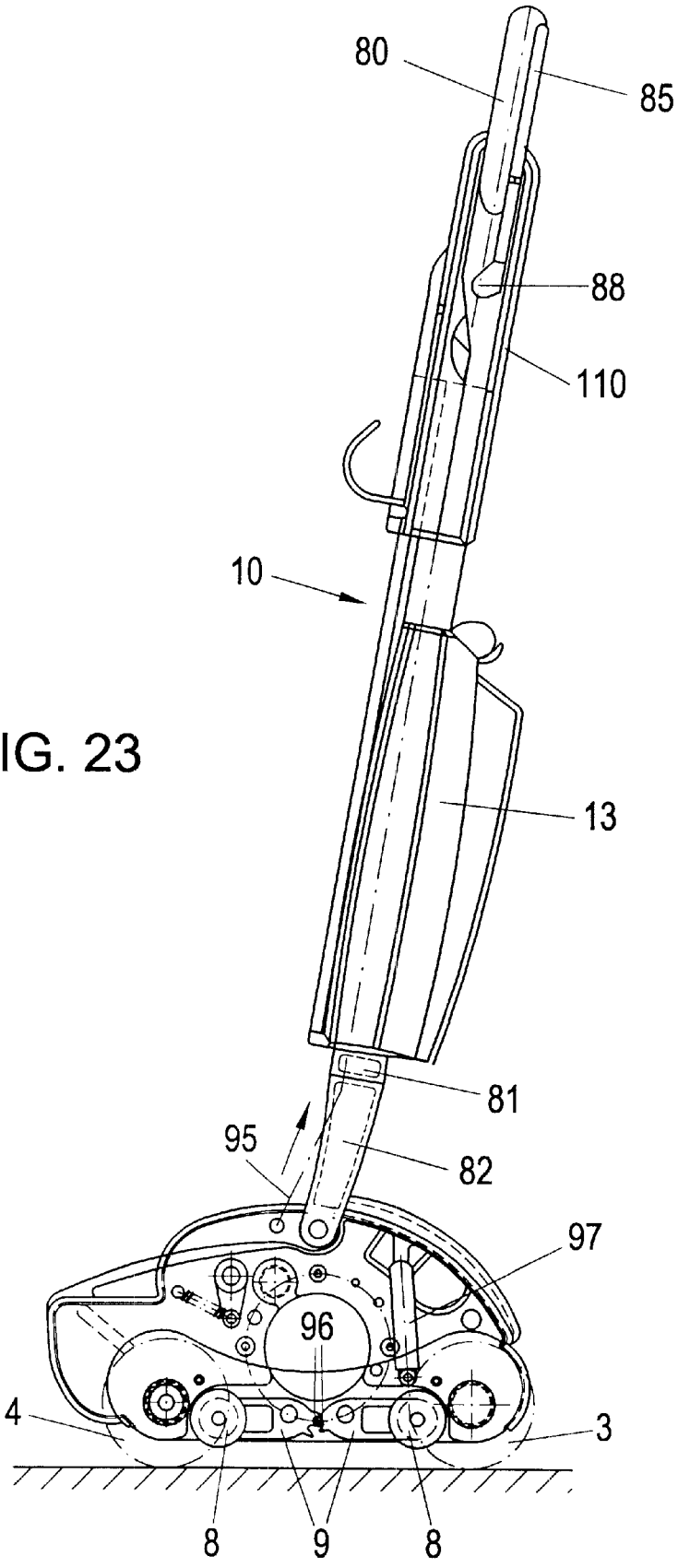

Compression spring devices 97 are provided for lowering the undercarriage, i.e., for rotating the wheel supports 9 from the position according to FIG. 23 into the position according to FIG. 22. In the embodiment illustrated in the drawing, the compression spring devices 97 are formed as stacked disks springs. Alternatively, the devices 97 can also be formed as conventional compression coil springs. First ends of the compression spring devices 97 are secured to the wheel supports 9 distal from the second ends of the wheel supports 9. The second ends of the compression spring devices 97 are secured to the floor cleaning machine, in particular to the side members 1, 2.

The compression spring devices 97 continually bias the wheel supports 9, wherein the bias force urges the wheel supports 9 to rotate into the extended position. To prevent this rotation, the cables 95 have to absorb this force, i.e. the second ends of the cables have to be fixedly attached, after the undercarriage is in the position shown in FIG. 23. When the wheel supports 9 are to be rotated into the position shown in FIG. 22, then only the attachment of the cables 95 will have to be manually released. The forces produced by the compression spring devices 97 can then freely act on and rotate the wheel supports 9.

In general, one cable 95 and one compression spring device 97 is provided for each wheel support 9. To reduce the number of cables 95 and compression spring devices 97, according to the invention, two wheel supports 9 can be aligned in the longitudinal direction, with the second ends of the wheel supports 9 making contact with each other (see also FIG. 2). The two ends are provided with meshing teeth 96. Consequently, pairs of wheel supports 9 are now coupled to each other, i.e., the rotation transmitted to one of the wheel supports 9 is transferred to the other wheel support, so that the two wheel supports 9 rotate synchronously.

With this coupling method, only one cable 95 and one compression spring device 97 have to be provided for each pair of wheel supports 9. It is unimportant for proper rotation to which of the two coupled wheel supports 9, the cable 95 and the compression spring device 97, respectively, are secured. In the embodiment illustrated in the drawing, the first end of the cable 95 is secured to the rear wheel support 9, whereas the first end of the compression spring device 97 is secured to the front wheel support 9.

To rotate the wheel supports 9, a force has to be applied to the second ends of the cables 95. For example, the two second ends may be arranged on the outside of the floor cleaning machine and directly attached to the ends of the cables.

According to a preferred embodiment of a floor cleaning machine illustrated in the drawing, the second ends of the cables are secured to a portion of the handle 10, so that the wheel supports 9 can be lifted by lifting a portion of the handle 10. This portion of the handle 10 is implemented in form of a lever that is pivotally supported on the handle 10. The portion of the handle 10 can also be formed by the motor switch lever 85, if the handle 10 includes a lever 85 for actuating the motor switch 86. Such a motor switch lever 85 is shown in the embodiment illustrated in the drawing, and the lever for operating the cable is constructed in the same manner as described above.

Figure 19:
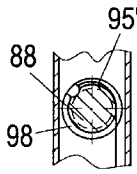
FIG. 19 is a partial section along the line XIX—XIX in FIG. 18.

As best seen in FIGS. 18 and 19, the two ends of the cables 95 are attached to the outer surface of the pivot shaft 88 of the lever 85. The second ends of all the cables 95 can also be routed to the outer surface of the pivot shaft 88. Likewise, the second ends of the cables 95 may also be connected with each other outside the floor cleaning machine and connected to the pivot shaft 88 through another cable 95' (see also FIG. 16*b*). When the lever 85 is rotated from the position according to FIG. 22 into the position according to FIG. 23, then the pivot shaft 88 is rotated counterclockwise, and the cable 95' is wound onto the pivot shaft 88, which pulls the cables 95 into the direction of the arrow of FIG. 22. The wheel supports 9 are thereby lifted.

When the lever 85 is rotated in the opposite direction, the cable 95' is unwound from the pivot shaft 88 and the cables 95 are released. The wheel supports 9 are then lowered by the bias force of the compression spring devices 97. The cables 95 can be locked after the undercarriage has reached the position indicated in FIG. 23, by holding the lever 85 by hand in the position shown in FIG. 23. The lever 85 hereby operates like a dead man's button, because the lever 85 has to be held down by hand while simultaneously operating the motor switch 86. If the lever 85 is released—even unintentionally—, then the compression spring devices 97 can rotate the wheel supports 9 downwardly. The cables 95, 95' are also pulled downwardly, so that the lever 85 rotates into the position shown in FIG. 22. The floor cleaning machine is then placed on the wheels 8 and the motor is switched off, so that the floor cleaning machine can no longer operate.

Disks 98 may be attached on the pivot shaft 88 on both sides of the attachment points of the cables 95 and to both sides of the attachment point of the cable 95', respectively. The cables 95, 95' are thereby held in a kind of pulley block.

Figure 24:
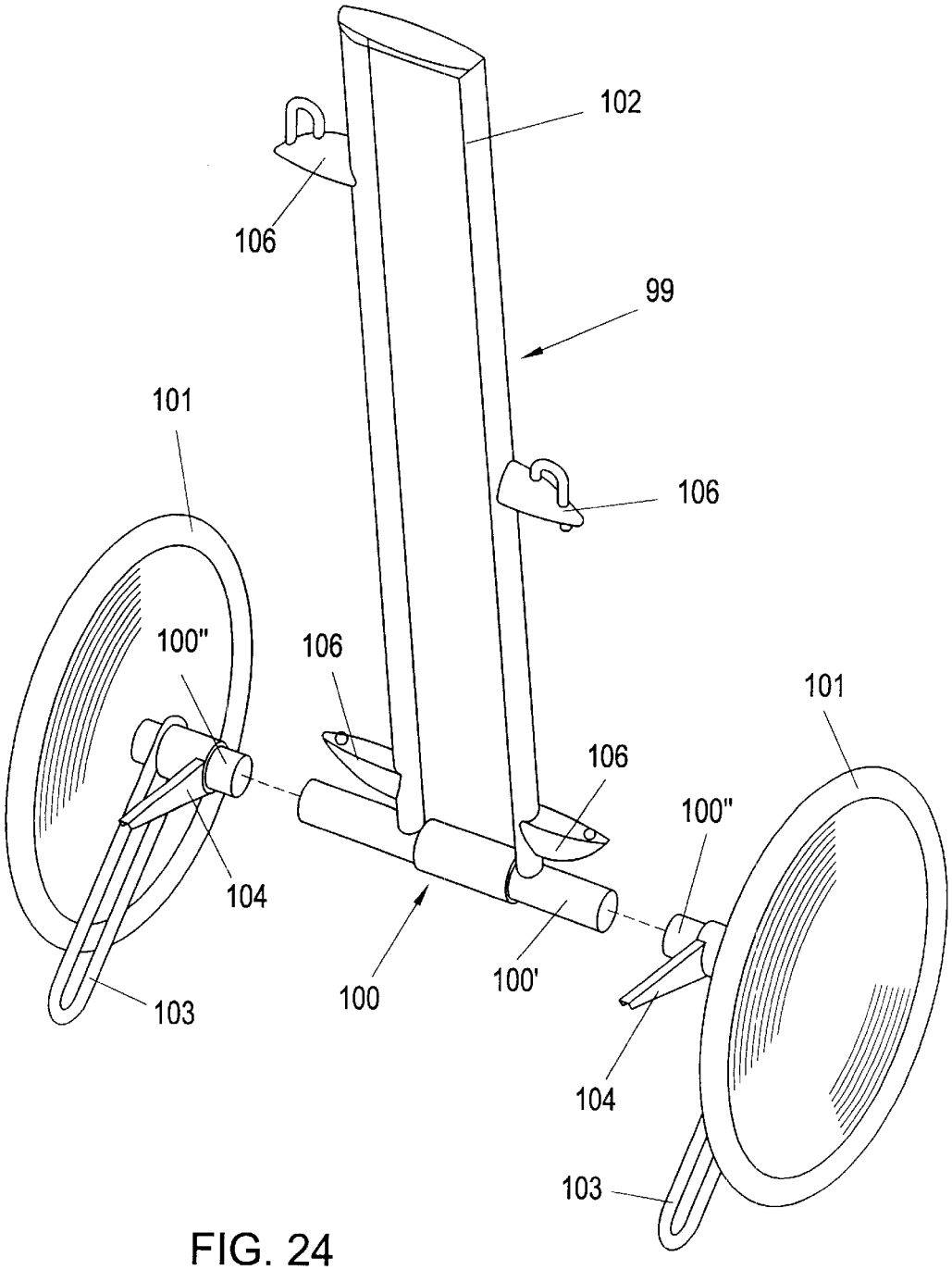
FIG. 24 a perspective view of a transport cart of the invention for a floor cleaning machine.
Figure 25:
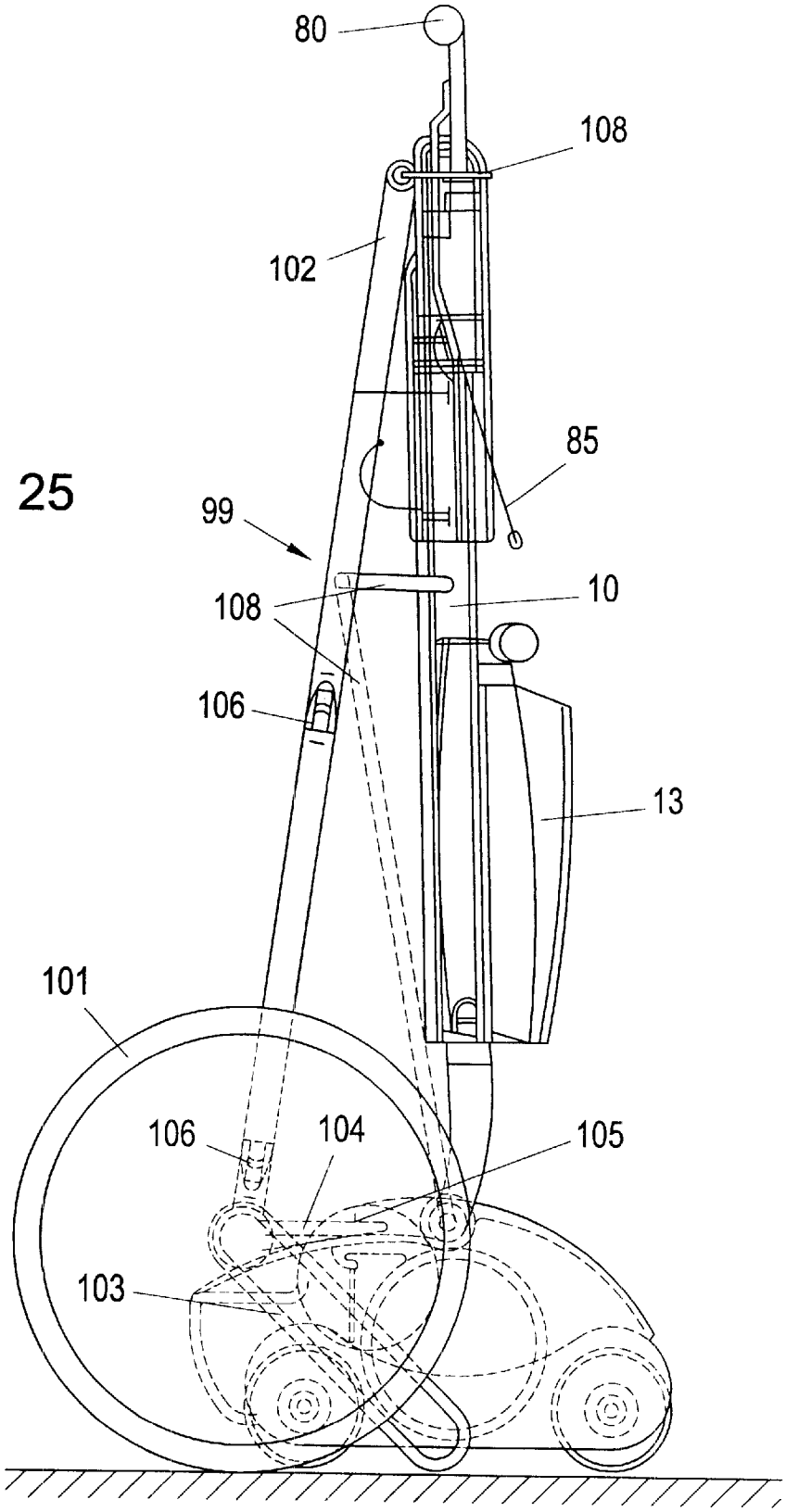
FIG. 25 the transport cart according to FIG. 24 with a floor cleaning machine secured to the transport cart.

Referring now to FIGS. 24 and 25, the arrangement of a transport cart according to the invention will be discussed. Such transport cart is adapted to transport a floor cleaning machine constructed in the manner described above. The transport cart has a frame 99, which comprises only four components: an essential component is the wheel axle mounting 100 for rotatable support of the wheels 101. Also secured to the wheel axle mounting 100 are a hand grip 102, support braces 103 and receiving rods 104. The wheel axle mounting 100 has three parts: a tubular center section 100' and wheel axle members 100" which are inserted into the end faces of the center section 100'. The support braces 103 and the receiving rods 104 are attached to the wheel axle components 100", whereas the hand grip 102 is attached to the center section 100'.

As a consequence of the three-part construction, the transport cart can be easily suited to a great number of cleaning machines of different widths. Only the length of the center section 100' has to be changed, whereas the basic design and the dimensions of all other components remain unchanged.

As seen in FIG. 25, the support members 103 support the transport cart in such a way that the hand grip 102 is oriented approximately perpendicular to the floor. A floor cleaning machine can be secured to the transport cart with the receiving rods 104. The receiving rods 104 engage in pockets 105 provided in the floor cleaning machine, more particularly pockets 105 located in the side members 1, 2 (see FIG. 25). The transport cart is lifted off the floor by tilting the machine counterclockwise. The support members 103 are then also lifted from the floor, so that the transport cart and the cleaning machine rest only on the wheels 101 of the transport cart. The transport cart and the floor cleaning machine can thus be easily moved.

The floor cleaning machine is lowered in a similar fashion: the transport cart is tilted clockwise until the cleaning machine makes contact with the floor (in the position shown in FIG. 25). The cart is then moved to the left (as shown in FIG. 25) and the receiving rods 104 are pulled out of the pockets 105.

A coupling member 108, such as a rope, a rigid strap or the like, is provided to reliably secure the floor cleaning machine on the transport cart. The coupling member 108 may be attached to both the frame 99 of the transport cart and to the floor cleaning machine. It is unimportant at what height the coupling member 108 is attached. As illustrated in the drawing, the coupling member 108 can be provided proximate to the upper end or near the center section of the hand grip 102. The coupling member 108 may be oriented approximately perpendicular to the hand grip 102 and to handle 10, respectively, of the floor cleaning machine. Alternatively, the coupling member 108 may also define an obtuse angle with the hand grip 102 and the handle 10, respectively, as indicated by the dashed line. The coupling member 108 is preferably securely fixed to the transport cart so that the coupling member 108 cannot get lost.

Holders 106 for accommodating spare parts of the floor cleaning machine, in particular replacement cylindrical brushes, are arranged on the hand grip 102 of the transport cart. The frame 99 may also include coverings to give the transport cart the same appearance as the floor cleaning machine.

While the invention has been illustrated and described as embodied in a floor cleaning machine, it is not intended to be limited to the details shown since various modifications and structural changes may be made without departing in any way from the spirit of the present invention.

What is claimed as new and desired to be protected by Letters Patent is set forth in the appended claims:

1. Drive system for a floor cleaning machine, comprising:

a motor comprising a motor drive shaft;

a gear mechanism connected to the motor drive shaft and comprising a first driven shaft and a second driven shaft;

a first brush driven by the first driven shaft for rotation about a first brush shaft and a second brush driven by the second driven shaft for rotation about a second brush shaft, the brushes formed as cylinders and rotating about their respective brush shafts in opposite directions;

a drum secured to a third driven shaft for rotation; and a transmission operatively connecting the third driven shaft to one of the first and second driven shafts for rotating the drum.

2. The drive system according to claim 1, wherein the first brush shaft is operatively connected to the first driven shaft by a first pair of toothed disks that are secured to the first brush shaft and the first driven shaft, respectively, and engage with a first toothed belt, and wherein the second brush shaft is operatively connected to the second driven shaft by a second pair of toothed disks that are secured to the second brush shaft and the second driven shaft, respectively, and engage with a second toothed belt.

3. The drive system according to claim 2, wherein the first and second pairs of toothed disks are made of steel, aluminum or plastic.

4. The drive system according to claim 1, wherein the transmission operatively connecting the third driven shaft to one of the first and second driven shafts includes a third toothed disk secured to a respective one of the first or second driven shafts; a fourth toothed disk secured to the third driven shaft of the drum; and a third toothed belt operatively connecting the third toothed disk with the fourth toothed disk.

5. The drive system of claim 1, wherein the gear mechanism includes a pinion secured to the motor drive shaft; two primary gear wheels engaging with the pinion; and a secondary gear wheel engaging with one of the primary gear wheels, wherein the second driven shaft is connected to one of the primary gear wheels and the first driven shaft is connected to the secondary gear wheel.

6. The drive system according to claim 5, wherein the pinion, the primary gear wheels and the secondary gear wheel are provided in the form of spur gears.

7. The drive system of claim 6, wherein the spur gears are made of steel.

8. The drive system according to claim 5, wherein the pinion, the primary gear wheels and the secondary gear wheel are provided in the form of helical gears.

9. The drive system of claim 1, wherein the motor is a synchronous motor.

10. The drive system of claim 1, and further comprising an electronic speed controller for the motor.

11. The drive system of claim 1, wherein the drum is positioned with respect to the rotating brushes so as to be able to cooperate with at least one of the brushes to receive dirt picked up by the at least one brush.

* * * * *